US009796068B2

(12) United States Patent
Jhones

(10) Patent No.: US 9,796,068 B2
(45) Date of Patent: Oct. 24, 2017

(54) ROTATABLE HAND-HELD BLADE-SHARPENING APPARATUS

(71) Applicant: Spyderco, Inc., Golden, CO (US)

(72) Inventor: Peter H. Jhones, Wellington, CO (US)

(73) Assignee: Spyderco, Inc., Golden, CO (US)

( * ) Notice: Subject to any disclaimer, the term of this patent is extended or adjusted under 35 U.S.C. 154(b) by 275 days.

(21) Appl. No.: 14/619,057

(22) Filed: Feb. 10, 2015

(65) Prior Publication Data

US 2015/0151408 A1 Jun. 4, 2015

Related U.S. Application Data

(63) Continuation-in-part of application No. 13/691,032, filed on Nov. 30, 2012, now Pat. No. 8,951,098.

(51) Int. Cl.

| | |
|---|---|
| ***B24B 3/54*** | (2006.01) |
| ***B24D 15/06*** | (2006.01) |
| ***B24D 18/00*** | (2006.01) |
| ***B24D 15/08*** | (2006.01) |

(52) U.S. Cl.

CPC ..... *B24D 15/06* (2013.01); *B24D 15/08* (2013.01); *B24D 18/00* (2013.01); *Y10T 29/4984* (2015.01)

(58) Field of Classification Search

CPC B24B 3/54; B24B 3/52; B24B 21/002; B24B 3/36; B24D 15/08; B24D 15/06

USPC ..... 451/555, 552, 557, 45; 76/82, 86, 88

See application file for complete search history.

(56) References Cited

U.S. PATENT DOCUMENTS

| | | | | |
|---|---|---|---|---|
| D116,704 | S | 9/1939 | Conway et al. | |
| D142,880 | S | 11/1945 | Loucony | |
| D153,706 | S | 5/1949 | Lathom | |
| 4,231,194 | A * | 11/1980 | Glesser | B24D 15/08 451/552 |
| 4,259,815 | A | 4/1981 | Kuban | |
| 4,450,653 | A * | 5/1984 | Fletcher | B24D 15/08 248/171 |
| 4,640,058 | A | 2/1987 | Glesser | |
| D290,222 | S | 6/1987 | Moody | |
| 4,696,129 | A | 9/1987 | Roberts | |
| 4,719,722 | A * | 1/1988 | Washburn | B24D 15/08 451/557 |
| 4,751,795 | A | 6/1988 | Jenne | |
| 4,759,153 | A | 7/1988 | Cohen | |
| 4,912,885 | A | 4/1990 | Bonapace | |
| D318,782 | S | 8/1991 | LeBeau | |
| D322,741 | S | 12/1991 | Jenne | |

(Continued)

FOREIGN PATENT DOCUMENTS

| | | |
|---|---|---|
| CA | 1130567 | 8/1982 |
| DE | 3041584 | 6/1982 |
| GB | 2084058 | 4/1982 |

OTHER PUBLICATIONS

Delavigne, "The Spyderco Story, The New Shape of Sharp," Paladin Enterprises, Inc., 2000, pp. 176-208.

(Continued)

*Primary Examiner* — Robert Rose

(74) *Attorney, Agent, or Firm* — Sheridan Ross P.C.

(57) ABSTRACT

A sharpening apparatus is provided. The sharpening apparatus includes a foldable case, a first sharpening tool, and a second sharpening tool. The first and second sharpening tools are associated with the foldable case and are rotatable between a storage position and a sharpening position.

17 Claims, 12 Drawing Sheets

(56) References Cited

U.S. PATENT DOCUMENTS

| | | | | |
|---|---|---|---|---|
| D326,989 | S | 6/1992 | Button et al. | |
| D327,402 | S | 6/1992 | Button et al. | |
| D328,847 | S | 8/1992 | Button et al. | |
| D333,081 | S | 2/1993 | Glesser | |
| D337,253 | S | 7/1993 | Glesser | |
| D353,988 | S | 1/1995 | Glesser | |
| 5,458,534 | A | 10/1995 | Campione et al. | |
| 5,477,753 | A | 12/1995 | Branscum et al. | |
| D365,740 | S | 1/1996 | Smith | |
| D367,598 | S | 3/1996 | Fortenberry | |
| D369,081 | S | 4/1996 | Byers et al. | |
| D387,262 | S | 12/1997 | Byers et al. | |
| D394,596 | S | 5/1998 | Byers et al. | |
| D404,278 | S | 1/1999 | Gore | |
| D406,038 | S | 2/1999 | Glesser | |
| D427,500 | S | 7/2000 | Glesser | |
| 7,381,120 | B2 * | 6/2008 | Henry | B24D 15/081 451/439 |
| 8,951,098 | B2 | 2/2015 | Jhones | |

OTHER PUBLICATIONS

"Ceramic Stick Sharpener," A.G. Russell Catalog, no date, Office Action for U.S. Appl. No. 29/082,235 dated Aug. 12, 1998, p. 35.

"Lansky Crock Pack Sharpener," Atlanta Cutlery Catalog, Spring 1996, p. 150.

Official Action for U.S. Appl. No. 29/082,235 dated Aug. 12, 1998, 5 pages.

Notice of Allowance for U.S. Appl. No. 29/082,235 dated Oct. 9, 1998, 3 pages.

Official Action for U.S. Appl. No. 29/103,288 dated Aug. 26, 1999, 5 pages.

Notice of Allowance for U.S. Appl. No. 29/103,288 dated Nov. 15, 1999, 3 pages.

Official Action for U.S. Appl. No. 13/691,032, dated Jun. 13, 2014, 6 pages.

Notice of Allowance for U.S. Appl. No. 13/691,032, dated Sep. 26, 2014, 5 pages.

* cited by examiner

ROTATABLE HAND-HELD BLADE-SHARPENING APPARATUS

CROSS-REFERENCE TO RELATED APPLICATION

This application is a Continuation-in-Part Application of and claims the benefit of priority from U.S. patent application Ser. No. 13/691,032 filed on Nov. 30, 2012, which is incorporated by reference herein in its entirety.

FIELD OF THE INVENTION

Embodiments of the present invention generally relate to sharpening devices. More specifically, embodiments of the present invention relate to a rotatable, hand-held, blade-sharpening apparatus.

BACKGROUND OF THE INVENTION

Cutting tools, such as axes, chisels, knives, scissors, razors, and various lawn and garden tools, generally include a blade having at least one cutting edge that dulls after a period of use. To increase the effectiveness and possibly extend the life of the cutting tool, various types of sharpeners are available to sharpen a cutting edge. For example, grinding wheels, honing steels, sharpening stones, and razor strops are commonly utilized in sharpening, straightening, and/or polishing a cutting edge.

Many times a cutting tool is used in field applications and becomes dull. Commonly, the operator of the cutting tool does not have a sharpener or does not have the time and/or patience to assembly a portable sharpener. Despite the number of existing sharpeners utilized to sharpen a cutting edge, there is still a need for an improved sharpener that is compact, lightweight, and easy to use, thereby accommodating field applications.

SUMMARY OF THE INVENTION

Embodiments of the present invention generally relate to a rotatable hand-held blade-sharpening apparatus. The blade-sharpening apparatus generally includes a foldable case that is compact, lightweight, durable, and protects a sharpening mechanism positioned within the case. The sharpening mechanism may be utilized to form and/or sharpen a cutting edge.

It is one aspect of embodiments of the present invention to provide a blade-sharpening apparatus utilizing a foldable case having a folded, or closed, position and an unfolded, or open, position of use. The foldable case may include a first cover plate rotatably interconnected to a second cover plate. In a folded position, the first cover plate and the second cover plate define an interior space that can accommodate at least one sharpening tool. The foldable case may include a closure mechanism to secure the foldable case in the folded position, which may include latches, straps, magnets, or other mechanisms now known or later developed in the art. In an unfolded position, the first cover plate and the second cover plate provide a base for the blade-sharpening apparatus. In one configuration, the first cover plate and the second cover plate lay flat in an unfolded position. The foldable case may include a locking mechanism to secure the foldable case in the unfolded position, which may include any locking device now known or later developed in the art. The foldable case generally may be constructed of metallic or non-metallic materials. For example, in one embodiment, the foldable case is constructed of a rigid plastic material.

It is another aspect of some embodiments of the present invention to provide a blade-sharpening apparatus utilizing at least one sharpening tool. The at least one sharpening tool may include a sharpening stone, a sharpening, or honing steel, or any other sharpening tool now known or later developed in the art. In one embodiment, the at least one sharpening tool comprises a sharpening rod which may have a circular, triangular, square, or other cross-section shape now known or later developed in the art. The at least one sharpening tool can be constructed of various materials including steel, diamond particles, ceramics such as silicon carbide or aluminum oxide, or other sharpening materials now known or later developed in the art. The at least one sharpening tool can be constructed of various grits including ultra-fine, fine, medium, coarse, or other grits now known or later developed in the art. The at least one sharpening tool also may include a furrow running the length of each tool which is utilized to sharpen pointed items like fishhooks, darts, broadheads, and awls.

It is another aspect of various embodiments of the present invention to provide a blade-sharpening apparatus utilizing at least one sharpening tool that is rotatable between a storage position and a sharpening position. In one embodiment, a first and a second sharpening tool are rotatable to preset angles in which the first and second sharpening tools are positioned at a predetermined angle relative to each other. The predetermined angle can include any range of angles that are utilized to sharpen and/or form a cutting edge. The predetermined sharpening angle eliminates guesswork in the field and provides a precision edge every time. In one embodiment, the predetermined angle is adjustable between a range of angles. If more than one sharpening tool is provided, each sharpening tool may rotate about a common axis of rotation or about separate axes of rotation. The at least one sharpening tool may be lockable in the storage and/or sharpening position.

It is another aspect of embodiments of the present invention to provide a blade-sharpening apparatus that includes at least one sharpening tool that automatically rotates to a predetermined sharpening position upon opening of a foldable case. In one embodiment, the rotation of a first sharpening tool and of a second sharpening tool about an axis of rotation is coupled to the rotation of a first cover plate and/or a second cover plate. In this embodiment, rotation of the first cover plate or the second cover plate from a folded position to an unfolded position rotates the first sharpening tool and the second sharpening tool from their respective storage positions to their respective sharpening positions, providing a sharpener that is fast and easy to use, especially in field applications.

It is another aspect of various embodiments of the present invention to provide a blade-sharpening apparatus that includes at least one hand guard that protects a user's hands from a cutting edge of a blade or tool while sharpening. The at least one hand guard may be rotatable between a storage position and a guard position, and may be lockable in the guard position. The rotation of the at least one hand guard may be coupled to the rotation of a first cover plate and/or a second cover plate to provide a sharpener that is safe, fast, and easy to use, especially in field applications. The at least one hand guard may be constructed of metallic or non-metallic materials. For example, in one embodiment, the at least one hand guard is a rod constructed of brass.

To assure that a user places their hand in the correct position under the hand guards, the opposing folding cover may have one or more barbs or projections extending from an interior surface to dissuade a user from placing their hand on that portion of the sharpening apparatus. These barbs may be mere extensions of the latch pins which are used to secure the first cover plate to the second cover plate in a closed position, or more aggressive projections to impart discomfort to a user.

It is one aspect of embodiments of the present invention to provide a hand-held sharpening apparatus with improved functionality when in the open position. Thus, the hand-held sharpening apparatus remains in an open and flat position even when a user misses the sharpening rod and/or hits the hand guards.

In one embodiment of the present invention, a blade-sharpening apparatus is provided comprising: a foldable case positionable between a folded and an unfolded position; a first sharpening tool having a first end and a second end, the first end of the first sharpening tool interconnected to the case, the first sharpening tool rotatable between a storage position and a sharpening position, the rotation of the first sharpening tool coupled to the positioning of the case; and a second sharpening tool having a first end and a second end, the first end of the second sharpening tool interconnected to the case, the second sharpening tool rotatable between a storage position and a sharpening position, the rotation of the second sharpening tool coupled to the positioning of the case.

In one embodiment of the present invention, a blade-sharpening apparatus is provided comprising: a first cover plate having a first end and a second end; a second cover plate having a first end and a second end, the first end of the second cover plate interconnected to at least one of the first end of the first cover plate or a hinge mechanism, at least one of the first or second cover plates rotatable between a folded and an unfolded position; a first holder having a first end and a second end, the first end of the first holder interconnected to at least one of the first cover plate, the second cover plate, or a hinge mechanism, the first holder rotatable between a storage position and a sharpening position; a first sharpening rod removably interconnected to the second end of the first holder; a second holder having a first end and a second end, the first end of the second holder interconnected to at least one of the first cover plate, the second cover plate, or a hinge mechanism, the second holder rotatable between a storage position and a sharpening position; and a second sharpening rod removably interconnected to the second end of the second holder.

In one embodiment of the present invention, a blade-sharpening apparatus is provided comprising: a foldable case positionable between a folded position and an unfolded position; a first sharpening tool having a first end and a second end, the first end of the first sharpening tool interconnected to the foldable case, the first sharpening tool rotatable between a storage position and a sharpening position, wherein rotation of the first sharpening tool is coupled to the foldable case; and a holder having a first end rotatably interconnected to the foldable case and a second end, wherein the first sharpening tool comprises a sharpening rod removably interconnected to the holder, and wherein the second end of the holder includes a predetermined geometry adapted to receive and selectively orient the sharpening rod. In a further embodiment, the blade-sharpening apparatus further comprises a second sharpening tool having a first end and a second end, the first end of the second sharpening tool interconnected to the foldable case, the second sharpening tool rotatable between a storage position and a sharpening position, and wherein a rotation of the second sharpening tool is coupled to the foldable case. In additional embodiments, the foldable case comprises a first cover plate rotatably interconnected to a second cover plate and the blade-sharpening apparatus further comprises a pin extending through an aperture in a first end of the first cover plate, a first end of the second cover plate, the first end of the first sharpening tool, and the first end of the second sharpening tool to interconnect the first sharpening tool and the second sharpening tool to the foldable case. In some embodiments, the when the foldable case is in the folded position, the first and second cover plates substantially enclose the first and second sharpening tools. In one embodiment, the sharpening rod has a triangular cross-section. In various embodiments, the first sharpening tool is adapted to be selectively locked in the sharpening position to retain a substantially fixed position. In alternative embodiments, the blade-sharpening apparatus comprises at least one hand guard with a first end which rotates about a common axis shared with the first sharpening tool, and having a second end which rotates to a position outside of at least one of a perimeter edge of the first cover plate and a perimeter edge the second cover plate.

In one embodiment of the present invention, a blade-sharpening apparatus is provided comprising: a first cover plate having a first end and a second end; a second cover plate having a first end and a second end, the first end of the second cover plate interconnected to at least one of the first end of the first cover plate and a hinge mechanism, wherein at least one of the first and second cover plates is rotatable between a folded position and an unfolded position; a first holder having a first end and a second end, the first end of the first holder interconnected to at least one of the first cover plate, the second cover plate, and the hinge mechanism, wherein the first holder is rotatable between a storage position and a sharpening position; a first sharpening rod removably interconnected to the second end of the first holder; a second holder having a first end and a second end, the first end of the second holder interconnected to at least one of the first cover plate, the second cover plate, and the hinge mechanism, wherein the second holder is rotatable between a storage position and a sharpening position; and a second sharpening rod removably interconnected to the second end of the second holder. In a further embodiment, when the first and second cover plates are in the unfolded positions, the first and second cover plates extend away from each other and act as a base of the blade-sharpening apparatus. In some embodiments, rotation of the first and second holders is coupled to at least one of the first and second cover plates, and wherein rotation of the at least one of the first and second cover plates from the folded position to the unfolded position rotates the first and second holders from their respective storage positions to their respective sharpening positions. In various embodiments, the first end of each holder includes a tab configured to interact with the first end of at least one of the first and second cover plates to couple the first and second holders to the at least one of the first and second cover plates. In some embodiments, the first and second holders are adapted to be selectively locked in their respective sharpening positions to retain a substantially fixed position. In a further embodiment, the blade-sharpening apparatus comprises at least one hand guard having an end interconnected to at least one of the first and second cover plates, wherein the at least one hand guard is rotatable. Thus, The blade-sharpening apparatus of Claim 15, wherein rotation of the at least one hand guard is coupled to the at least one of the first and second cover plates, wherein rotation of the at least one of the first and second cover plates from the folded position to the unfolded position rotates the at least one hand guard from a storage position to a guard position. In some embodiments, the first and second sharpening tools are oriented at a predetermined angle relative to each other when the first and second sharpening tools are in their respective sharpening positions. In additional embodiments, the blade-sharpening apparatus further comprises a pin extending through an aperture in the first end of the first cover plate, the first end of the second cover plate, the first end of the first holder, and the first end of the second holder to interconnect the first and second holders to the first and second cover plates.

In one embodiment of the present invention, a method of assembling a foldable blade-sharpening apparatus is provided comprising: providing a foldable case configured to rotate between a folded and an unfolded position, a first sharpening tool having a first end and a second end, and a second sharpening tool having a first end and a second end; interconnecting the first end of the first sharpening tool to the foldable case so that the first sharpening tool is rotatable between a first position of storage and a second position of sharpening; interconnecting the first end of the second sharpening tool to the foldable case so that the second sharpening tool is rotatable between a first position of storage and a second position of sharpening; and coupling the rotation of the first and second sharpening tools to the rotation of the foldable case, wherein the first and second sharpening tools are oriented in a substantially common plane in the first position of storage and oriented in two distinct planes, each at a predetermined angle, in the second position of sharpening.

The method may further comprise providing a first and second hand guard each having a first end and a second end, interconnecting the first end of the first hand guard to the foldable case so that the first hand guard is rotatable between a first position of storage and a second position of use, and interconnecting the first end of the second hand guard to the foldable case so that the second hand guard is rotatable between a first position of storage and a second position of use. The first and second hand guards may be coupled to rotate to a common plane when the foldable case is moved from an unfolded position to a folded position.

In one embodiment of the present invention, a method of positioning a blade-sharpening apparatus into a sharpening position is provided comprising: providing a blade-sharpening apparatus comprising: a first cover plate having a first end and a second end; a second cover plate having a first end and a second end, the first end of the second cover plate rotatably interconnected to the first end of the first cover plate; a first sharpening tool having a first end and a second end, the first end of the first sharpening tool rotatably interconnected to the first ends of the first and second cover plates, wherein the first sharpening tool is rotatable between a first position of storage and a second position of sharpening; and a second sharpening tool having a first end and a second end, the first end of the second sharpening tool rotatably interconnected to the first ends of the first and second cover plates, wherein the second sharpening tool is rotatable between a first position of storage and a second position of sharpening, and wherein when rotated to the second position of sharpening, the first and second sharpening tools are positioned at a predetermined angle relative to each other; and rotating the first cover plate or the second cover plate from the folded position to the unfolded position, wherein rotation of the first or second cover plate rotates the first and second sharpening tools from their respective storage positions to their respective sharpening positions. When in the unfolded position, the first and second cover plates may form a base oriented in a substantially horizontal plane.

In another embodiment of the present invention, the hand guards rotate outwardly during opening of the first and second cover plates, and thus extend outwardly from the perimeter edges of the first and second cover plates. In one embodiment, this outward rotation is created by a unique geometric configuration in the knuckles of the hand guards.

In one embodiment of the present invention, a method of positioning a blade-sharpening apparatus into a sharpening position is provided comprising: providing a foldable case configured to rotate between a folded position and an unfolded position, a first sharpening tool having a first end and a second end, and a second sharpening tool having a first end and a second end; interconnecting the first end of the first sharpening tool to the foldable case, wherein the first sharpening tool is rotatable between a first position of storage and a second position of sharpening; interconnecting the first end of the second sharpening tool to the foldable case, wherein the second sharpening tool is rotatable between a first position of storage and a second position of sharpening; and coupling the first and second sharpening tools to the foldable case, wherein when the first and second sharpening tools are in their respective first positions of storage the first and second sharpening tools are oriented in a substantially common plane, wherein when the first and second sharpening tools are in their respective second positions of sharpening the first and second sharpening tools are oriented in two distinct planes, and wherein each plane of the two distinct planes is at a predetermined angle. In a further embodiment, the method further comprises: providing a first hand guard having a first end and a second end and a second hand guard having a first end and a second end; interconnecting the first end of the first hand guard to the foldable case, wherein the first hand guard is rotatable between a first position of storage and a second position of use; and interconnecting the first end of the second hand guard to the foldable case, wherein the second hand guard is rotatable between a first position of storage and a second position of use, and wherein the first and second hand guards are operably interconnected to the foldable case to rotate to a common plane when the foldable case is rotated from the unfolded position to the folded position and an outer-most end of the first hand guard and an outer-most end of the second hand guard are positioned outside of a peripheral edge of the foldable case.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof are open-ended and can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The Summary of the Invention is neither intended nor should it be construed as being representative of the full extent and scope of embodiments of the present invention. Embodiments of the present invention are set forth in various levels of detail in the Summary as well as in the attached drawings and the Detailed Description and no limitation as to the scope of the claimed subject matter is intended by either the inclusion or non-inclusion of elements, components, etc. in this Summary. Moreover, reference made herein to "the present invention" or aspects thereof should be understood to mean certain embodiments of the present invention and should not necessarily be construed as limiting all embodiments to a particular description.

BRIEF DESCRIPTION OF THE DRAWINGS

The accompanying drawings, which are incorporated in and constitute a part of the specification, illustrate embodiments of the disclosure and together with the general description given above and the detailed description of the drawings given below, serve to explain the principles of these embodiments.

Figure 1A:
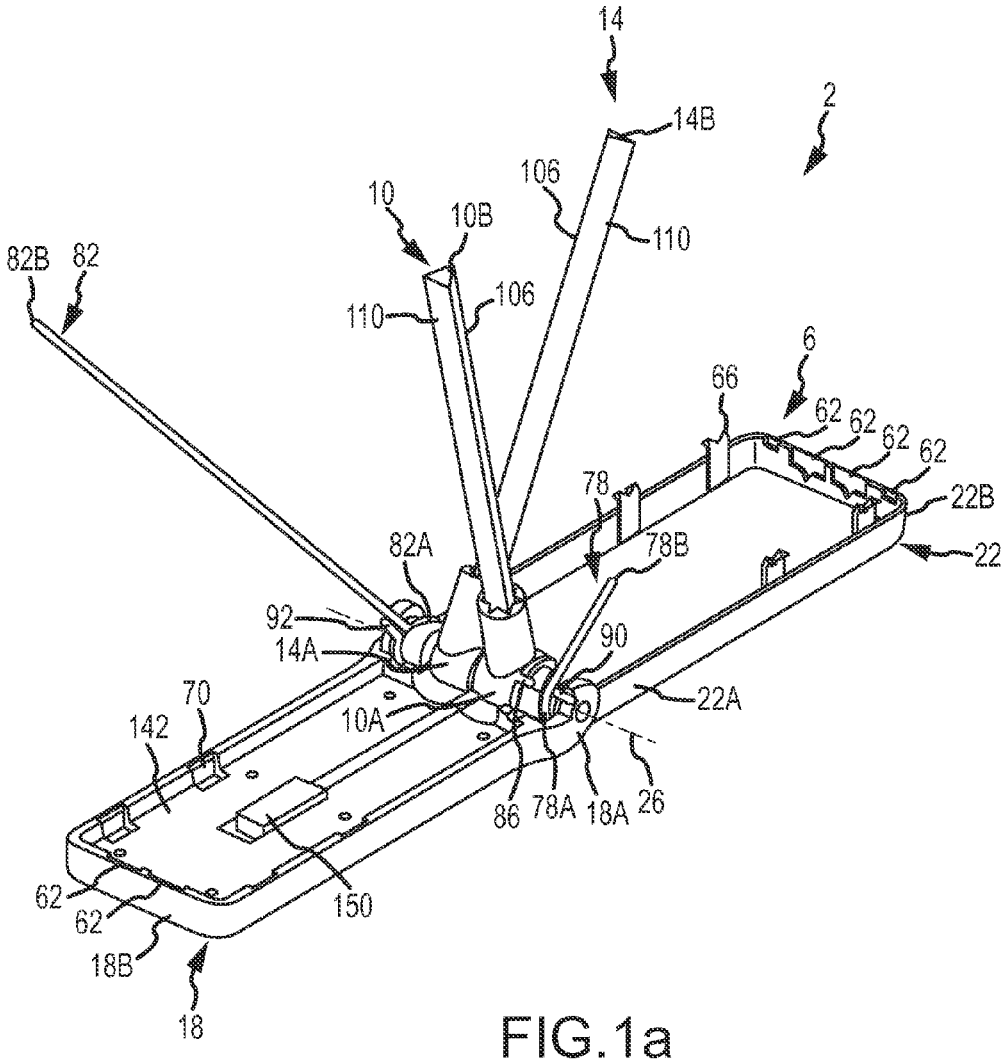
FIG. 1*a* is a perspective view of one embodiment of a blade-sharpening apparatus in an unfolded position.

It should be understood that the drawings are not necessarily to scale. In certain instances, details that are not necessary for an understanding of the disclosure or that render other details difficult to perceive may have been omitted. It should be understood, of course, that the claimed invention is not necessarily limited to the particular embodiments illustrated herein.

To assist in the understanding of the drawings, the following is a list of components and associated numbering found in the drawings:

Components
2 Blade-sharpening apparatus
2A Blade-sharpening apparatus
2B Blade-sharpening apparatus
2C Blade-sharpening apparatus
6 Foldable case
10 First sharpening tool
10A First end of first sharpening tool
10B Second end of first sharpening tool
14 Second sharpening tool
14A First end of second sharpening tool
14B Second end of second sharpening tool
18 First cover plate
18A First end of first cover plate
18B Second end of first cover plate
19 Perimeter edge of first cover plate
22 Second cover plate
22A First end of second cover plate
22B Second end of second cover plate
23 Perimeter edge of second cover plate
26 Axis of rotation
30A First knuckle of first cover plate
30B Second knuckle of first cover plate
30C Third knuckle of first cover plate
30D Fourth knuckle of first cover plate
34A Contact surface of first knuckle of first cover plate
34B Contact surface of second knuckle of first cover plate
34C Contact surface of third knuckle of first cover plate
Components
34D Contact surface of fourth knuckle of first cover plate
38A Radially-inward exterior surface of first knuckle of first cover plate
38B Radially-inward exterior surface of second knuckle of first cover plate
38C Radially-inward exterior surface of third knuckle of first cover plate
38D Radially-inward exterior surface of fourth knuckle of first cover plate
42A Radially-outward exterior surface of first knuckle of first cover plate
42B Radially-outward exterior surface of second knuckle of first cover plate
42C Radially-outward exterior surface of third knuckle of first cover plate
42D Radially-outward exterior surface of fourth knuckle of first cover plate
46A First knuckle of second cover plate
46B Second knuckle of second cover plate
46C Third knuckle of second cover plate
46D Fourth knuckle of second cover plate
50A Contact surface of first knuckle of second cover plate
50B Contact surface of second knuckle of second cover plate

50C Contact surface of third knuckle of second cover plate
50D Contact surface of fourth knuckle of second cover plate
54A Radially-inward exterior surface of first knuckle of second cover plate
54B Radially-inward exterior surface of second knuckle of second cover plate
54C Radially-inward exterior surface of third knuckle of second cover plate
54D Radially-inward exterior surface of fourth knuckle of second cover plate
58A Radially-outward exterior surface of first knuckle of second cover plate
58B Radially-outward exterior surface of second knuckle of second cover plate
58C Radially-outward exterior surface of third knuckle of second cover plate
58D Radially-outward exterior surface of fourth knuckle of second cover plate
62 Receptacles
66 Protruding latch members
70 Latch receptacles
78 First hand guard
78A First end of first hand guard
Components
78B Second end of first hand guard
82 Second hand guard
82A First end of second hand guard
82B Second end of second hand guard
86 Tab of first sharpening tool
88 Tab of second sharpening tool
90 Tab of first hand guard
92 Tab of second hand guard
94 Sharpening rod
98 Holder
98A First end of holder
98B Second end of holder
102 Keyed slots
106 Corner of sharpening rod
110 Flat side of sharpening rod
114 Cavity
118 Ball
122 Spring
126 Side surface of holder
130 Recess in side surface of holder
134 Locking mechanism
138 Fasteners
142 Cap plate
146 Slidable rod
146A First end of slidable rod
146B Second end of slidable rod
150 Finger grip
154 Spring
158 Groove
162 Vertical plane
Components
166 Horizontal plane
180 Slot
182 First interconnection point of biasing mechanism
184 Second interconnection point of biasing mechanism
186 First half of biasing mechanism
188 Second half of biasing mechanism
222A First end of second cover plate
222B Second end of second cover plate
226 Bar
278 First hand guard
278A First end of first hand guard
278B Second end of first hand guard
282 Second hand guard
282A First end of second hand guard
282B Second end of second hand guard
290 Tab of first hand guard
292 Tab of second hand guard

DETAILED DESCRIPTION

Referring to FIGS. 1-14C, embodiments of a blade-sharpening apparatus 2, 2A, 2B, 2C are provided. The blade-sharpening apparatus 2, 2A, 2B, 2C generally includes a foldable case 6, a first sharpening tool 10 having a first end 10A rotatably interconnected to the foldable case 6, and a second sharpening tool 14 having a first end 14A rotatably interconnected to the foldable case 6. The foldable case 6 may include a first cover plate 18 rotatably interconnected to a second cover plate 22. In the depicted embodiments, the first sharpening tool 10, the second sharpening tool 14, the first cover plate 18, and the second cover plate 22 are rotatably interconnected about a common axis of rotation 26. However, in alternative embodiments, the blade-sharpening apparatus 2, 2A, 2B, 2C may include multiple rotation axes. For example, in one alternative embodiment, each rotatable component rotates about a unique axis of rotation.

Figure 1B:
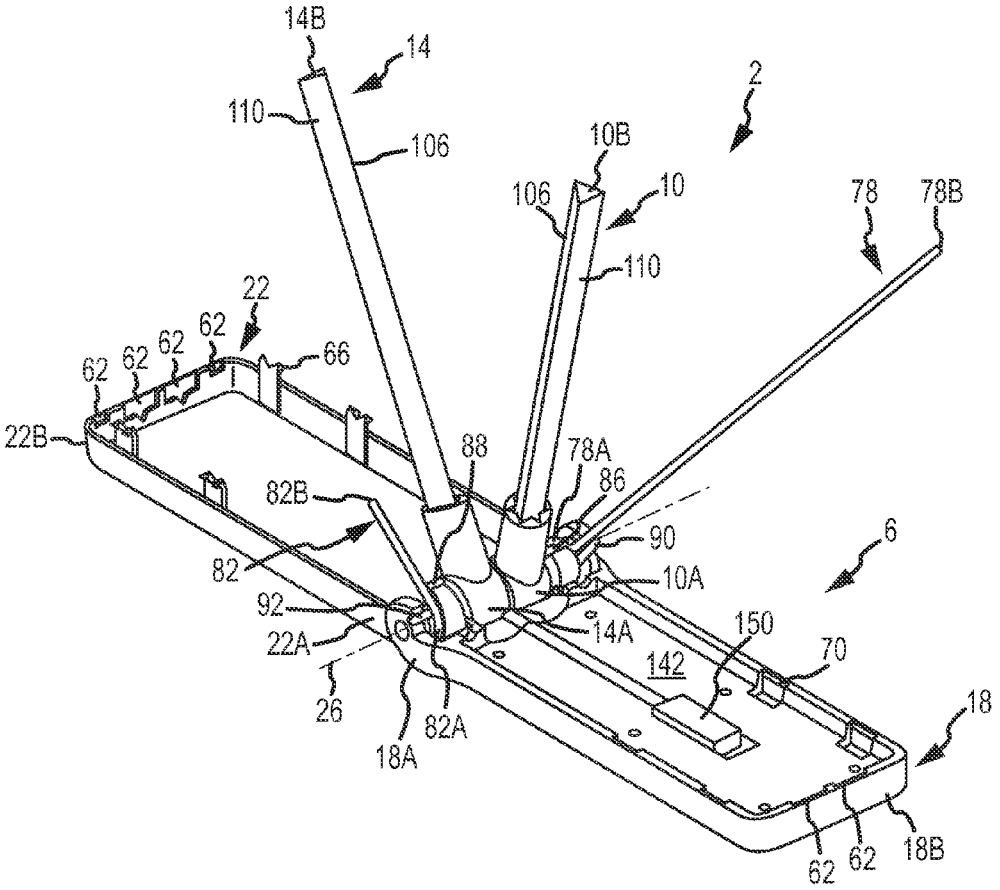
FIG. 1*b* is another perspective view of the blade-sharpening apparatus shown in FIG. 1*a* in an unfolded position.

With reference to FIGS. 1-2, one embodiment of a blade-sharpening apparatus 2 in an unfolded position is depicted. The blade-sharpening apparatus 2 includes a foldable case 6 having a first cover plate 18 rotatably interconnected to a second cover plate 22 about an axis of rotation 26. In addition, a first sharpening tool 10 and a second sharpening tool 14 are rotatably interconnected to the first cover plate 18 and the second cover plate 22 about the axis of rotation 26.

Figure 2A:
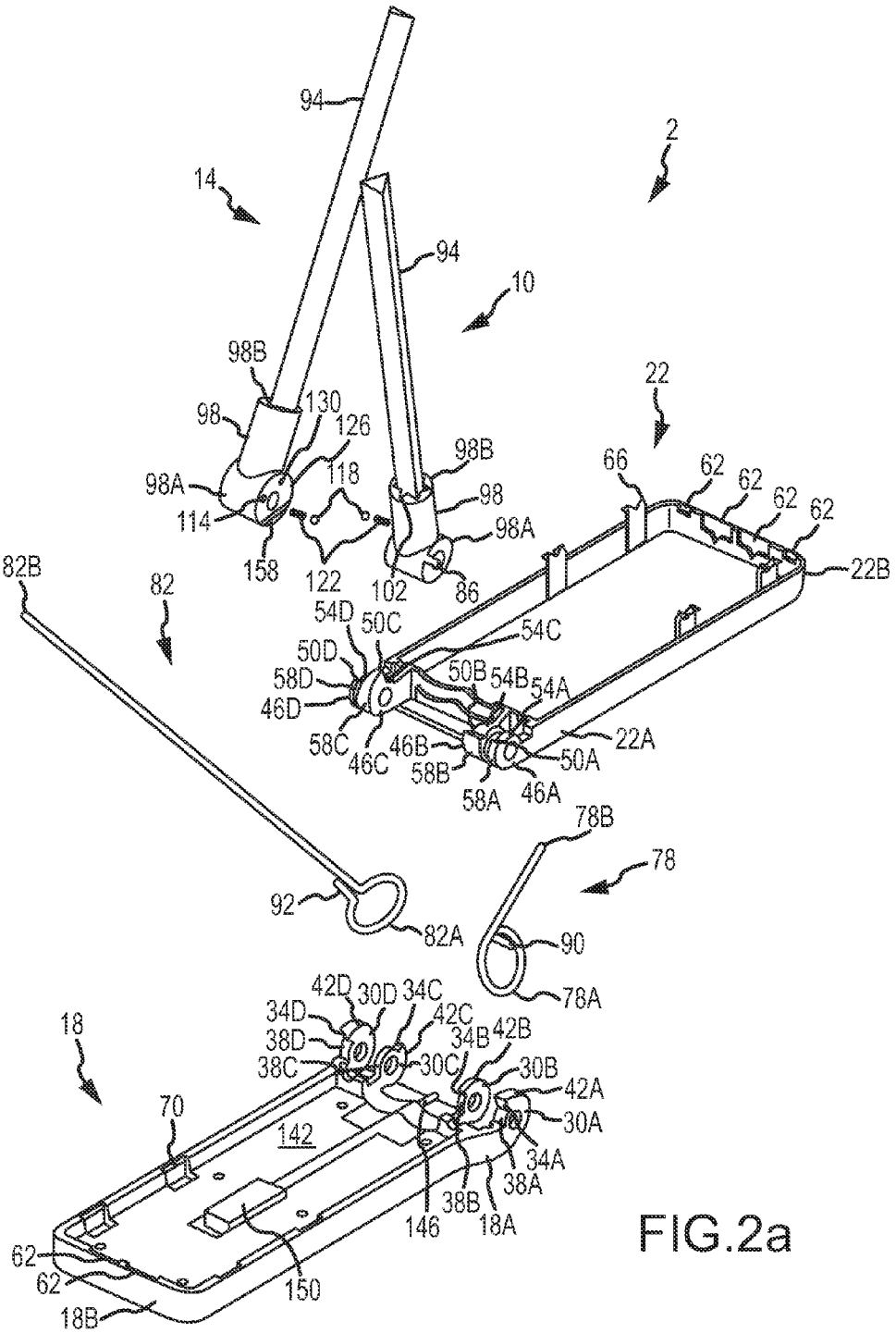
FIG. 2*a* is an exploded perspective view of the blade-sharpening apparatus shown in FIG. 1*a;*
Figure 2B:
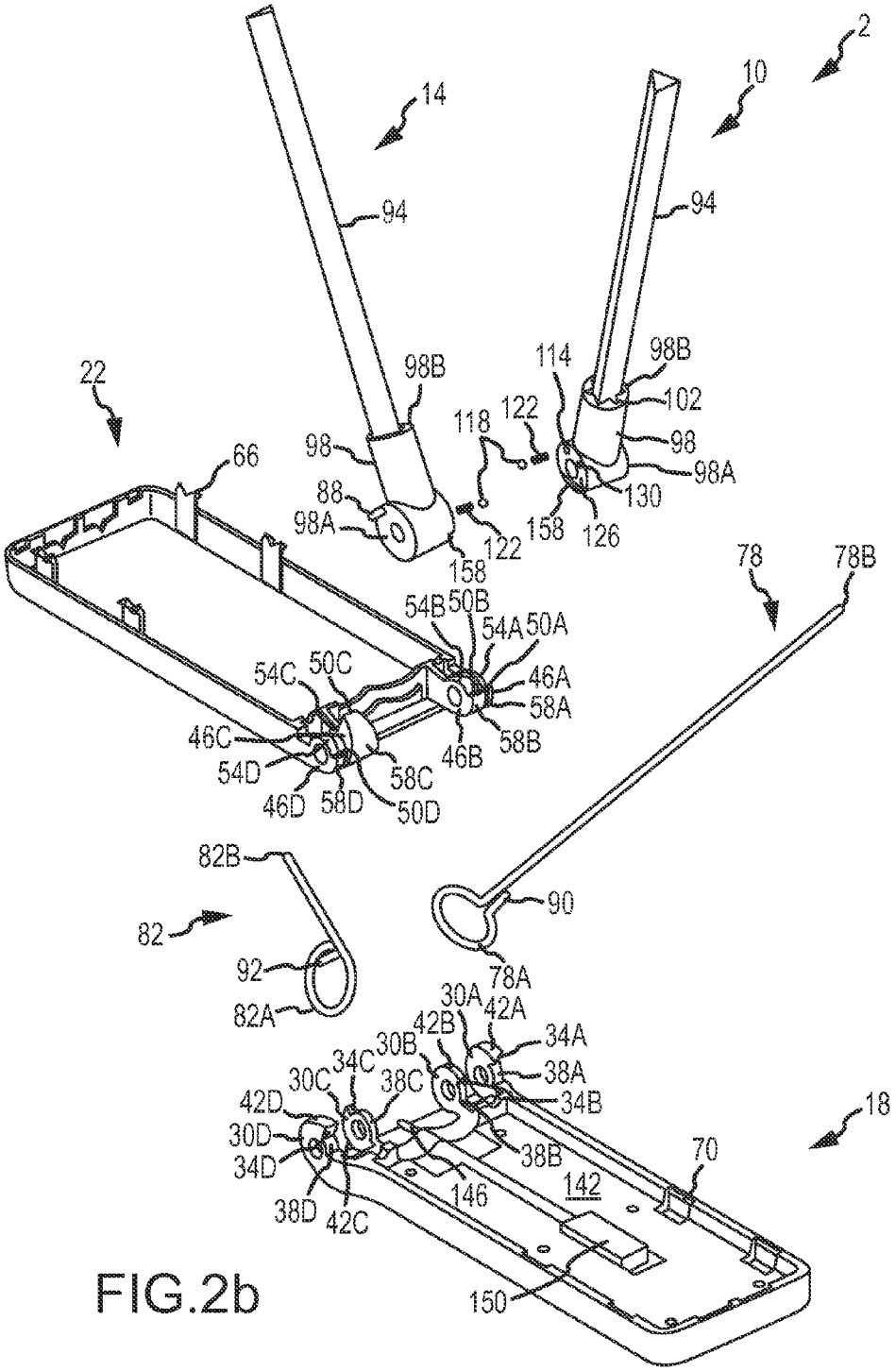
FIG. 2*b* is an exploded perspective view of the blade-sharpening apparatus shown in FIG. 1*b;*

The first cover plate 18 has a first end 18A and a second end 18B. The first end 18A of the first cover plate 18 includes a plurality of knuckles 30A, 30B, 30C, 30D, each of which generally comprises a hollow cylinder configured to accommodate a pivot pin. As illustrated in FIGS. 2A-2B, the knuckles 30A, 30B, 30C, 30D are generally separated from each other along the axis of rotation 26. In addition, each knuckle 30A, 30B, 30C, 30D has a contact surface 34A, 34B, 34C, 34D that is formed between a radially-inward exterior surface 38A, 38B, 38C, 38D and a radially-outward exterior surface 42A, 42B, 42C, 42D, respectively. The contact surfaces 34A, 34B, 34C, 34D are formed in the knuckles 30A, 30B, 30C, 30D, respectively, at predetermined angles about the axis of rotation 26. As illustrated, the outermost knuckles 30A, 30D each include a contact surface 34A, 34D, respectively, which are formed at approximately equal angles about the axis of rotation 26, whereas the innermost knuckles 30B, 30C each include a contact surface 34B, 34C, respectively, which are formed at differing angles about the axis of rotation 26 relative to each other. The purpose of the contact surfaces 34A, 34B, 34C, 34D will be discussed below.

Similar to the first cover plate 18, the second cover plate 22 has a first end 22A and a second end 22B. The first end 22A of the second cover plate 22 includes a plurality of knuckles 46A, 46B, 46C, 46D, each of which generally comprises a hollow cylinder configured to accommodate a pivot pin. As illustrated in FIGS. 2A-2B, the knuckles 46A, 46B, 46C, 46D are generally separated from each other along the axis of rotation 26. In addition, each knuckle 46A, 46B, 46C, 46D has a contact surface 50A, 50B, 50C, 50D that is formed between a radially-inward exterior surface 54A, 54B, 54C, 54D and a radially-outward exterior surface 58A, 58B, 58C, 58D, respectively. The contact surfaces 50A, 50B, 50C, 50D are formed in the knuckles 46A, 46B, 46C, 46D, respectively, at predetermined angles about the axis of rotation 26. As illustrated, the outermost knuckles 46A, 46D each include a contact surface 50A, 50D, respectively, which are formed at approximately equal angles about the axis of rotation 26, whereas the innermost knuckles 46B, 46C each include a contact surface 50B, 50C, respectively, which are formed at differing angles relative to each other about the axis of rotation 26. The purpose of the contact surfaces 50A, 50B, 50C, 50D will be discussed below.

When assembled, the knuckles 46A, 46B of the second cover plate 22 are positioned between the knuckles 30A, 30B of the first cover plate 18, and the knuckles 46C, 46D of the second cover plate 22 are positioned between the knuckles 30C, 30D of the first cover plate 18. In this configuration, the first end 22A of the second cover plate 22 can be rotatably interconnected to first end 18A of the first cover plate 18 about the axis of rotation 26 by inserting a pivot pin through the knuckles 30A, 30B, 30C, 30D of the first cover plate 18 and the knuckles 46A, 46B, 46C, 46D of the second cover plate 22.

The first cover plate 18 and the second cover plate 22 may have at least one receptacle 62 configured to receive a first sharpening tool 10 and/or a second sharpening tool 14 when the blade-sharpening apparatus 2 is in a folded position. For example, as illustrated, receptacles 62 are formed in the first end 18A and the second end 18B of the first cover plate 18, as well as in the first end 22A and the second end 22B of the second cover plate 22. The receptacles 62 in the second ends 18B, 22B of the first cover plate 18 and the second cover plate 22, respectively, may be configured to receive various sharpening tools, including triangular and circular cross-sections.

The blade-sharpening apparatus 2 also may include a latch mechanism configured to join the first cover plate 18 and the second cover plate 22 together when in a closed position, while allowing for the cover plates 18, 22 to be separated from each other upon application of a predetermined amount of force. As illustrated, the first cover plate 18 includes a plurality of protruding latch members 66 configured to engage corresponding latch receptacles 70 formed in the second cover plate 22. Upon closure of the foldable case 6, each protruding latch member 66 contacts a corresponding latch receptacle 70 and elastically deforms until the protruding latch member 66 snaps into a corresponding latch receptacle 70. To open the case 6 from a closed position, a predetermined amount of force is applied to the first cover plate 18 and/or second cover plate 22, which elastically deforms each protruding latch member 66 to allow the first cover plate 18 to separate from the second cover plate 22. The number of latch members can be varied. For example, in one embodiment, only one protruding latch member and one corresponding latch receptacle are utilized. Also, the placement of the protruding latch member 66 and the latch receptacle 70 can be varied. For example, the first cover plate 18 may include a protruding latch member 66 and/or a latch receptacle 70, and similarly the second cover plate 22 may include a protruding latch member 66 and/or a latch receptacle 70.

Still referring to FIGS. 1-2, the blade-sharpening apparatus 2 includes a plurality of sharpening tools rotatably interconnected to the foldable case 6. In particular, a first sharpening tool 10 has a first end 10A rotatably interconnected to the first end 18A of the first cover plate 18 and to the first end 22A of the second cover plate 22 about the axis of rotation 26, which may be accomplished by use of a pivot pin, and a second end 10B. A second sharpening tool 14 has a first end 14A rotatably interconnected to the first end 18A of the first cover plate 18 and to the first end 22A of the second cover plate 22 about the axis of rotation 26, which may be accomplished by use of a pivot pin, and a second end 14B. The number of sharpening tools can vary. For example, in one alternative embodiment, only one sharpening tool is included in the blade-sharpening apparatus. In another alternative embodiment, a plurality of sharpening tools is included in the blade-sharpening apparatus, which may include three or more sharpening tools.

Figure 10:
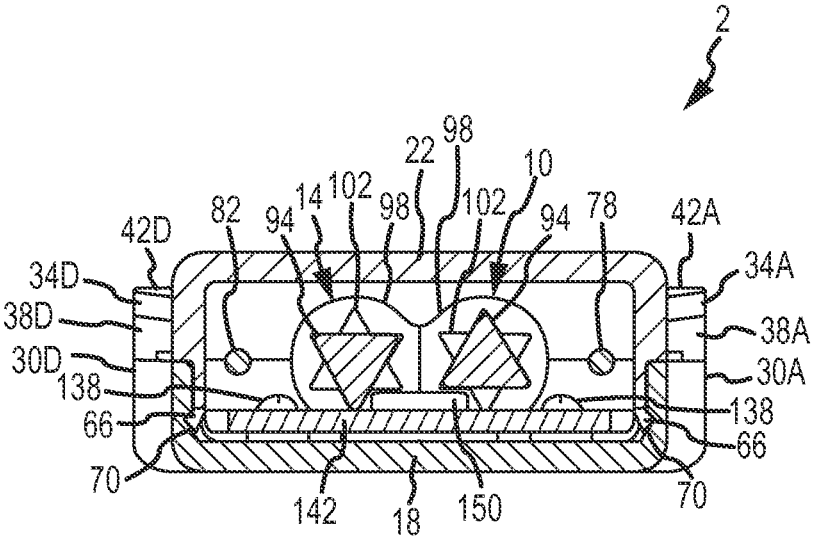
FIG. 10 is a cross-section view taken along line 10-10 of the blade-sharpening apparatus shown in FIG. 7.

The first sharpening tool 10 and the second sharpening tool 14 are rotatable between a storage position, shown in FIG. 10, and a sharpening position, shown in FIGS. 1 and 3-5. When rotated to the sharpening position, the first sharpening tool 10 and the second sharpening tool 14 are positioned at a predetermined angle relative to each other. The predetermined angle between the first sharpening tool 10 and the second sharpening tool 14 may be altered based on the desired sharpening angle of the edge of the blade. In one embodiment, the predetermined angle may be preset between 0 degrees and about 90 degrees. For example, common predetermined angles include about 20 degrees for very sharp edges, about 30 degrees for typical knife edges, about 40 degrees or more for tough edges such as that used to chop, and about 60 degrees for extremely durable edges such as chisels or drawknives. As another example, a common predetermined angle for scissors is about 25 degrees. In one specific embodiment, sharpening tools 10, 14 are preset at about 90 degrees relative to each other, or about 45 degrees relative to a vertical plane passing through an axis of rotation 26.

Each blade-sharpening apparatus 2 may be preset to a particular predetermined angle and thus tailored for specific applications. For example, if the predetermined angle is preset at 30 degrees, the first sharpening tool 10 would have a sharpening position that is 15 degrees counterclockwise from a vertical plane passing through the axis of rotation 26, and the second sharpening tool 14 would have a sharpening position that is 15 degrees clockwise from the vertical plane. Alternatively, a blade-sharpening apparatus 2 may include an adjustable predetermined angle, discussed in more detail below, for any angle between a predetermined range. For example, in one embodiment, a blade sharpening apparatus 2 includes sharpening tools that can be adjusted between about 20 to about 90 degrees relative to each other, or between about 10 to about 45 degrees relative to a vertical plane passing through the axis of rotation 26.

The blade-sharpening apparatus 2 also may include at least one hand guard. In FIGS. 1-2, the blade-sharpening apparatus 2 includes a first hand guard 78 and a second hand guard 82. The first hand guard 78 and the second hand guard 82 each have a first end 78A, 82A rotatably interconnected to the first end 18A of the first cover plate 18 and to the first end 22A of the second cover plate 22 about the axis of rotation 26, which may be accomplished by use of a pivot pin, and a second end 78B, 82B. The first hand guard 78 and the second hand guard 82 are rotatable between a storage position, shown in FIG. 10, and a guard position, shown in FIGS. 1 and 3-5. When rotated to the guard position, the first hand guard 78 and the second hand guard 82 are positioned at approximately the same predefined angle relative the first cover plate 18 and the first rotatable tool 10. Similar to the predetermined angle of the sharpening tools, the predefined angle of the hand guards may be preset to a particular angle or adjustable. Generally, the hand guards 78, 82 protect a user's hand while sharpening. In one embodiment, a blade sharpening apparatus 2 includes hand guards 78, 82 that can be preset between about 30 to about 150 degrees relative to each other, or between about 15 to about 75 degrees relative to a vertical plane passing through the axis of rotation 26. In one specific embodiment, hand guards 78, 82 are preset at about 106 degrees relative to each other, or about 53 degrees relative to a vertical plane passing through the axis of rotation 26.

The rotation of the first sharpening tool 10, the second sharpening tool 14, the first hand guard 78, and/or the second hand guard 82 about the axis of rotation 26 may be coupled to the rotation of the first cover plate 18 and the second cover plate 22. For example, rotation of the first cover plate 18 or the second cover plate 22 from a folded position to an unfolded position may rotate the first sharpening tool 10 and the second sharpening tool 14 from their respective storage positions to their respective sharpening positions. Similarly, rotation of the first cover plate 18 or the second cover plate 22 from a folded position to an unfolded position may rotate the first hand guard 78 and the second hand guard 82 from their respective storage positions to their respective guard positions. Further, rotation of the first cover plate 18 or second cover plate 22 from an unfolded to a folded position may rotate the first sharpening tool 10, second sharpening tool 14, first hand guard 78, and/or second hand guard 82 to their respective storage positions, as shown in FIG. 10.

Still referring to FIGS. 1-2, the first end 10A of the first sharpening tool 10 and the first end 14A of the second sharpening tool 14 may each include a tab 86 that extends generally parallel to the axis of rotation 26. The tab 86 formed on the first end 10A of the first sharpening tool 10 is configured to interact with the contact surface 34B formed in the second knuckle 30B of the first cover plate 18 and/or the contact surface 50B formed in the second knuckle 46B of the second cover plate 22. The tab 86 formed on the first end 14A of the second sharpening tool 14 is configured to interact with the contact surface 34C formed in the third knuckle 30C of the first cover plate 18 and/or the contact surface 50C formed in the third knuckle 46C of the second cover plate 22.

In operation, if the second cover plate 22 is rotated about the axis of rotation 26 to unfold the foldable case 6 from a folded position to an unfolded position, the contact surface 50B formed in the second knuckle 46B of the second cover plate 22 contacts the tab 86 formed on the first end 10A of the first sharpening tool 10, and the contact surface 50C formed in the third knuckle 46C of the second cover plate 22 contacts the tab 88 formed on the first end 14A of the second sharpening tool 14, and the contact surfaces 50B, 50C rotate the first sharpening tool 10 and the second sharpening tool 14, respectively, to their sharpening positions. Similarly, if the first cover plate 18 is rotated about the axis of rotation 26 to unfold the foldable case 6 from a folded, or closed, position, to an unfolded position, the contact surface 34B formed in the second knuckle 30B of the first cover plate 18 contacts the tab 86 formed on the first end 10A of the first sharpening tool 10, and the contact surface 34C formed in the third knuckle 30C of the first cover plate 18 contacts the tab 88 formed on the first end 14A of the second sharpening tool 14, and the contact surfaces 34B, 34C rotate the first sharpening tool 10 and the second sharpening tool 14, respectively, to their sharpening positions.

When the foldable case 6 is in the unfolded position, the contact surfaces 34B, 50B formed in the second knuckles 30B, 46B of the first cover plate 18 and the second cover plate 22, respectively, contact opposing sides of the tab 86 formed in the first end 10A of the first sharpening tool 10 to lock the first sharpening tool 10 in a sharpening position. Similarly, the contact surfaces 34C, 50C formed in the third knuckles 30C, 46C of the first cover plate 18 and the second cover plate 22, respectively, contact opposing sides of the tab 88 formed in the first end 14A of the second sharpening tool 14 to lock the second sharpening tool 14 in a sharpening position. By altering the angle of the contact surfaces about the axis of rotation 26, the sharpening angle of the first sharpening tool 10 and of the second sharpening tool 14 can be altered. In one embodiment, the contact surfaces are adjustable about the axis of rotation 26. For example, the contact surfaces may be formed as part of telescopic members that telescopically extend about the axis of rotation 26. The telescopic members may be lockable at predetermined angles. In one configuration, the telescopic members include marks that correspond to predetermined sharpening angles to assist a user in selecting a sharpening angle for the first sharpening tool 10 and the second sharpening tool 14.

Still referring to FIGS. 1-2, the first end 78A of the first hand guard 78 and the first end 82A of the second hand guard 82 each include a tab 90, 92, respectively, that generally extends along the axis of rotation 26. The tab 90 formed on the first end 78A of the first hand guard 78 is configured to interact with the contact surface 34A formed in the first knuckle 30A of the first cover plate 18 and/or the contact surface 50A formed in the first knuckle 46A of the second cover plate 22. The tab 92 formed on the first end 82A of the second hand guard 82 is configured to interact with the contact surface 34D formed in the fourth knuckle 30D of the first cover plate 18 and/or the contact surface 50D formed in the fourth knuckle 46D of the second cover plate 22.

In operation, if the second cover plate 22 is rotated about the axis of rotation 26 to unfold the foldable case 6 from a folded position, to an unfolded position, the contact surface 50A formed in the first knuckle 46A of the second cover plate 22 contacts the tab 90 formed on the first end 78A of the first hand guard 78, and the contact surface 50D formed in the fourth knuckle 46D of the second cover plate 22 contacts the tab 92 formed on the first end 82A of the second hand guard 82, and the contact surfaces 50A, 50D rotate the first hand guard 78 and the second hand guard 82, respectively, to their guard positions. Similarly, if the first cover plate 18 is rotated about the axis of rotation 26 to unfold the foldable case 6 from a folded position to an unfolded position, the contact surface 34A formed in the first knuckle 30A of the first cover plate 18 contacts the tab 90 formed on the first end 78A of the first hand guard 78, and the contact surface 34D formed in the fourth knuckle 30D of the first cover plate 18 contacts the tab 92 formed on the first end 82A of the second hand guard 82, and the contact surfaces 34A, 34D rotate the first hand guard 78 and the second hand guard 82, respectively, to their guard positions.

When the foldable case 6 is in the unfolded position, the contact surfaces 34A, 50A formed in the first knuckles 30A, 46A of the first cover plate 18 and the second cover plate 22, respectively, contact opposing sides of the tab 90 formed in the first end 78A of the first hand guard 78 to lock the first hand guard 78 in a guard position. Similarly, the contact surfaces 34D, 50D formed in the fourth knuckles 30D, 46D of the first cover plate 18 and the second cover plate 22, respectively, contact opposing sides of the tab 92 formed in the first end 82A of the second hand guard 82 to lock the second hand guard 82 in a guard position. By altering the angle of the contact surfaces about the axis of rotation 26, the guard angle of the first hand guard 78 and the second hand guard 82 can be altered. Similar to the contact surfaces corresponding to the sharpening tools, the contact surfaces corresponding to the hand guards may be adjustable about the axis of rotation 26.

Referring to FIGS. 1-5, the first sharpening tool 10 and the second sharpening tool 14 may each comprise a sharpening rod 94 removably interconnected to a holder 98. Each holder 98 has a first end 98A rotatably interconnected to the first end 18A of the first cover plate 18 and to the first end 22A of the second cover plate 22 about the axis of rotation 26. In addition, each holder 98 has a second end 98B configured to receive an end of a sharpening rod 94. In FIGS. 1-5, the sharpening rods 94 each have a triangular cross-section. In alternative embodiments, the sharpening rods 94 may have circular or other cross-sections now known or later developed in the art. In FIGS. 1-5, the second end 98B of each holder 98 includes predetermined geometry, or keyed slots 102, adapted to receive and selectively orient a sharpening rod 94. The keyed slots 102 allow triangular sharpening rods 94 to be selectively oriented about their longitudinal axis. For example, as illustrated, each sharpening rod 94 is oriented in the keyed slots 102 such that a corner 106 faces inward. In this orientation, serrated edges of a blade can be sharpened. Alternatively, each sharpening rod 94 may be oriented in the keyed slots 102 such that a flat side 110 faces inward. In this alternative orientation, plain edges of a blade can be sharpened. In one embodiment, each holder 98 may include slots that are angled relative to the axis of rotation 26 to further allow a user to alter the sharpening angle of each sharpening rod 94.

Figure 6:
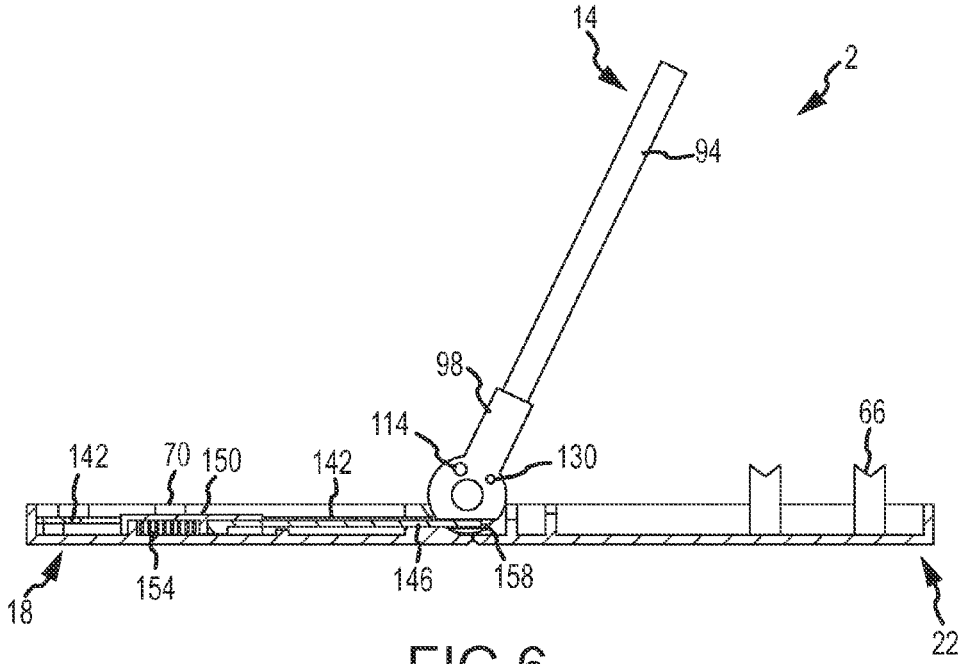
FIG. 6 is cross-section view taken along line 6-6 of the blade-sharpening apparatus shown in FIG. 5.

Referring to FIGS. 1-2 and 6, the first sharpening tool 10 and the second sharpening tool 14 may be lockable in a sharpening position. As previously discussed, the knuckles of the first cover plate 14 and the second cover plate 18 may include features that lock the first sharpening tool 10 and the second sharpening tool 14 in their respective sharpening positions. In addition, each holder 98 may house a ball detent in a cavity 114 formed in the first end 98A of each holder 98. If provided, a ball 118 is interconnected to a spring 122, and the spring 122 and ball 118 are placed in the cavity 114 such that a portion of the ball 118 protrudes out of the cavity 114. When assembled, the ball 118 contacts a side surface 126 of an adjacent holder 98, compresses the spring 122, and is retracted into the cavity 114. The ball 118 remains refracted in the cavity 114 until the first sharpening tool 10 and the second sharpening tool 14 are rotated into their sharpening positions, at which point a recess 130 formed in the side surface 126 of the adjacent holder 98 aligns with the cavity 114, allowing the spring 122 to expand and position a portion of the ball 118 in the recess 130. Alternatively, other types of retention mechanisms known in the art may be used.

In one embodiment, a locking mechanism 134 may be interconnected to one of the cover plates. In FIGS. 1-2, 5-6, and 10, the locking mechanism 134 is interconnected to the first cover plate 18 with a plurality of fasteners 138 that may engage a plurality of holes formed in a cap plate 142 or a plurality of bosses formed in the cover plate. The locking mechanism 134 includes a cap plate 142, a slidable rod 146 having a first end 146A and a second end 146B, a finger grip 150 interconnected to the second end 146B of the slidable rod 146, and a spring 154 operably associated with the finger grip 150. The spring 154 may be configured to bias the finger grip 150, and thus the slidable rod 146, towards an unlocked or locked position. In a locked position, the first end 146A of the slidable rod 146 slides into a groove 158 formed in each holder 98 of the first sharpening tool 10 and the second sharpening tool 14. In operation, when each holder 98 associated with the first sharpening tool 10 and the second sharpening tool 14 rotates into a sharpening position, each groove 158 formed in the side surface 126 of each holder 98 aligns with each other and with the path of the slidable rod 146, thereby allowing the first end 146A of the slidable rod 146 to be slidably positioned in grooves 158 to lock the first sharpening tool 10 and the second sharpening tool 14 in their respective sharpening positions. Alternatively, the locking mechanism 134 may be oriented perpendicular to the longitudinal axis of the cover plate 18 or 22, and may extend through the rotating holders 98 of the sharpening rods or tabs 90 and 92 of the hand guards to lock the first and second sharpening tools and hand guards in the sharpening position.

Figure 3:
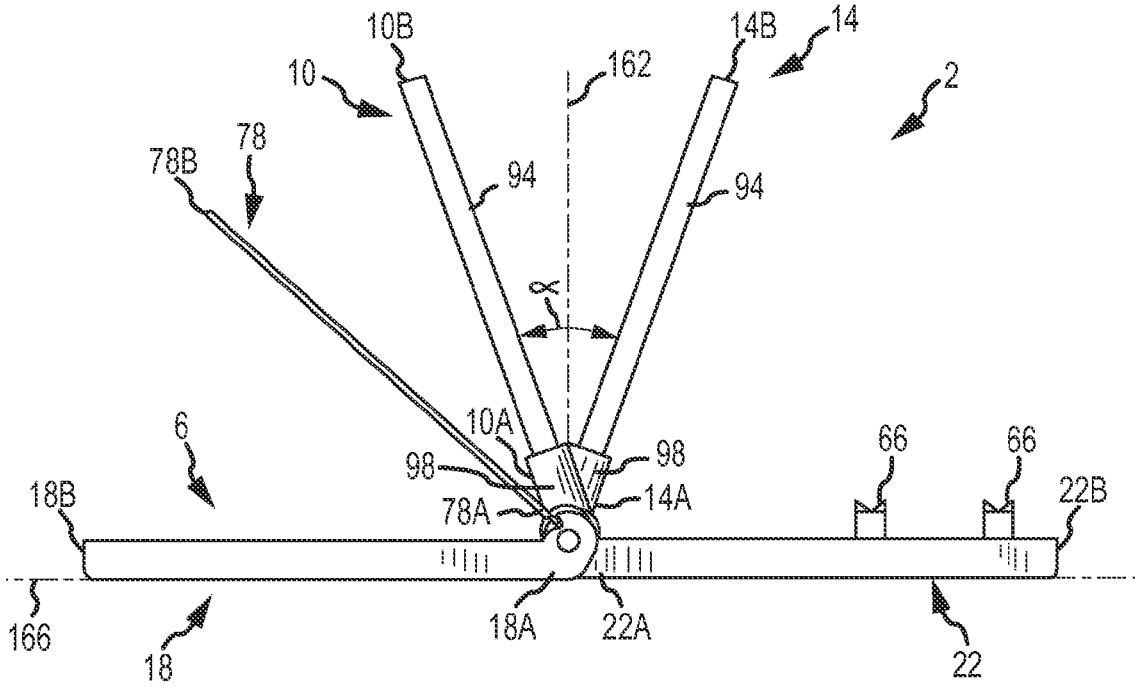
FIG. 3 is a front elevation view of the blade-sharpening apparatus shown in FIG. 1.

Referring now to FIG. 3, a front elevation view of a blade-sharpening apparatus 2 is provided. In FIG. 3, the first sharpening tool 10 and the second sharpening tool 14 have been rotated to a sharpening position in which the first sharpening tool 10 and the second sharpening tool 14 are positioned at a predetermined angle $\alpha$ relative to each other. The predetermined angle $\alpha$ is bisected by a vertical plane 162 passing through the axis of rotation 26. As previously discussed, the predetermined angle may be based on the particular tool to be sharpened and may be adjustable. Also illustrated in FIG. 3, hand guards 78, 82 have been rotated to a guard position in which the hand guards 78, 82 are positioned between the first sharpening tool 10 and the first cover plate 18. In this configuration, a user can safely place their hand on the first cover plate 18 to hold the blade-sharpening apparatus 2 stationary.

Also shown in FIG. 3, the first cover plate 18 and the second cover plate 22 have been rotated to an unfolded position in which the first cover plate 18 and the second cover plate 22 extend away from each other and act as a base of the blade-sharpening apparatus 2. In FIG. 3, the first cover plate 18 and the second cover plate 22 are positioned substantially co-planar with a horizontal plane 166. As such, in this embodiment, the first cover plate 18 and the second cover plate 22 are rotatable between about 180 degrees. The range of motion of the first cover plate 18 and the second cover plate 22 can be altered depending on the application. For example, in one alternative embodiment, the first cover plate 18 and the second cover plate 22 are rotatable between about 270 degrees.

Figure 4:
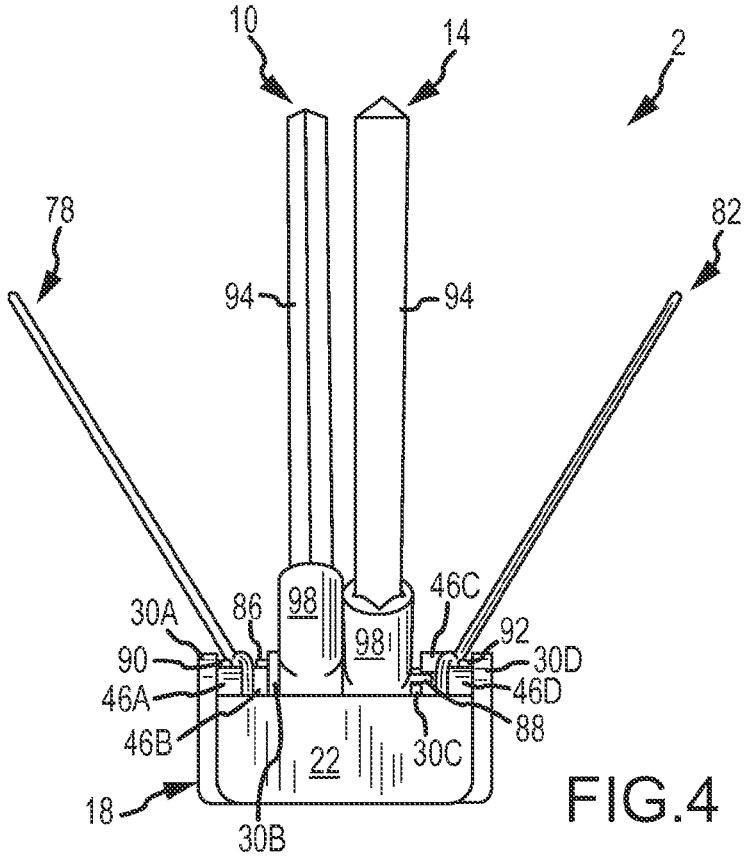
FIG. 4 is a right-side elevation view of the blade-sharpening apparatus shown in FIG. 1 without latch members.
Figure 5:
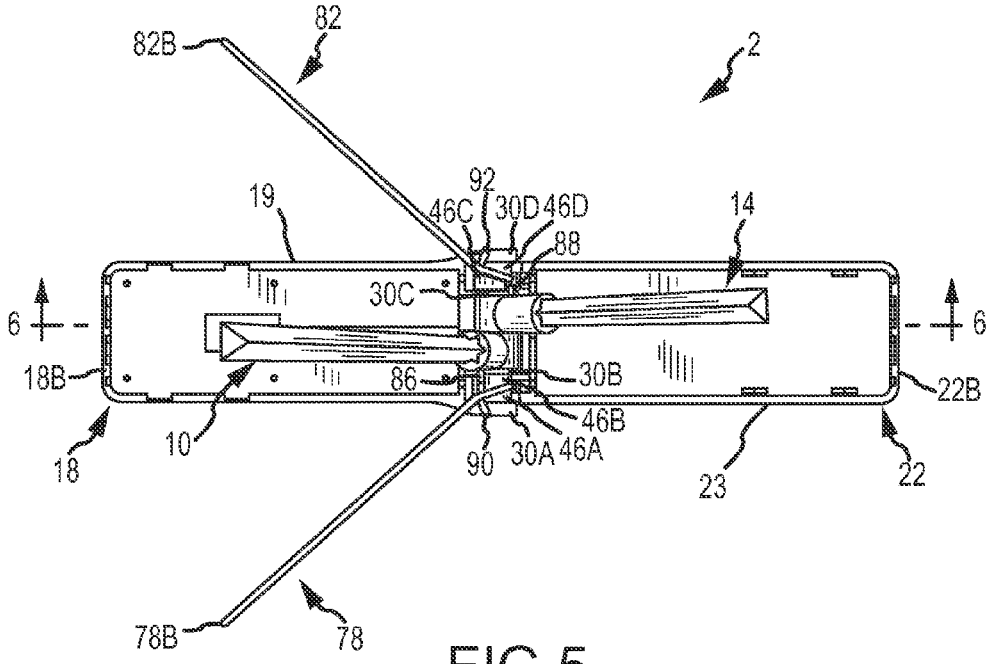
FIG. 5 is a top plan view of the blade-sharpening apparatus shown in FIG. 1.

Referring now to FIG. 4, a right-side elevation view of a blade-sharpening apparatus 2 is provided. The first hand guard 78 and the second hand guard 82 have been rotated to a guard position in which the hand guards 78, 82 are angled outwardly from the first sharpening tool 10 and the second sharpening tool 14. Specifically, when the hand guards 78, 82 are rotated to the guard position, a second end 78B of the first hand guard 78 is rotated to a position outside of a perimeter edge 19 of the first cover plate 18 and/or a perimeter edge 23 of the second cover plate 22 and a second end 82B of the second hand guard 82 is rotated to a position outside of the perimeter edge 19 of the first cover plate 18 and/or the perimeter edge 23 of the second cover plate 22. Thus, the hand guards 78, 82 extend outwardly from the perimeter edges 19, 23 of the first and second cover plates 18, 22. The outward orientation helps protect a user's hand, wrist, and/or arm when placed on the first cover plate 18. As illustrated in FIG. 5, the first end 78A of the first hand guard 78 is positioned between the first knuckle 46A and the second knuckle 46B of the second cover plate 22, and the first end 82A of the second hand guard 82 is positioned between the third knuckle 46C and the fourth knuckle 46D of the second cover plate 22. The sides of the knuckles 46A, 46B, 46C, 46D guide the hand guards 78, 82 during rotation between a storage position and a guard position. When in the storage position, the hand guards 78, 82 are positioned within an interior space defined by the first cover plate 18 and the second cover plate 22. When in the guard position, the hand guards 78, 82 extend beyond the outermost exterior surfaces of the first cover plate 18 and the second cover plate 22 to provide additional protection for a user's hand during sharpening. The outward orientation of the hand guards 78, 82 relative to the cover plates 18, 22 and/or the sharpening tools 10, 14 may be altered in various embodiments.

Referring to FIG. 6, a cross-section view taken along line 6-6 of the blade-sharpening apparatus 2 shown in FIG. 5 is illustrated. A locking mechanism 134 is interconnected to the first cover plate 22 with a plurality of fasteners 138. A slidable rod 146 is disposed beneath a cap plate 142 and is positioned in grooves 158 formed in the side surface 126 of a holder 98 to lock the holder 98 in a sharpening position. A spring 154 biases the slidable rod 146 towards the unlocked position, in which the blade-sharpening apparatus 2 can rotate into a folded or an unfolded position. A finger grip 150 is operably associated with the spring 154 and the slidable rod 146 to allow a user to position the slidable rod 146 within the grooves 158, thereby locking the holder 98 in its sharpening position. Once the slidable rod 146 operably engages the holders 98, the slidable rod 146 may be locked into place. Alternatively, a locking mechanism may be positioned in perpendicular orientation to the longitudinal axis of the cover and can be selectively positioned to lock the cover plates, hand guards 78, 82, and sharpening tools 10, 14 in a sharpening position.

Figure 7:
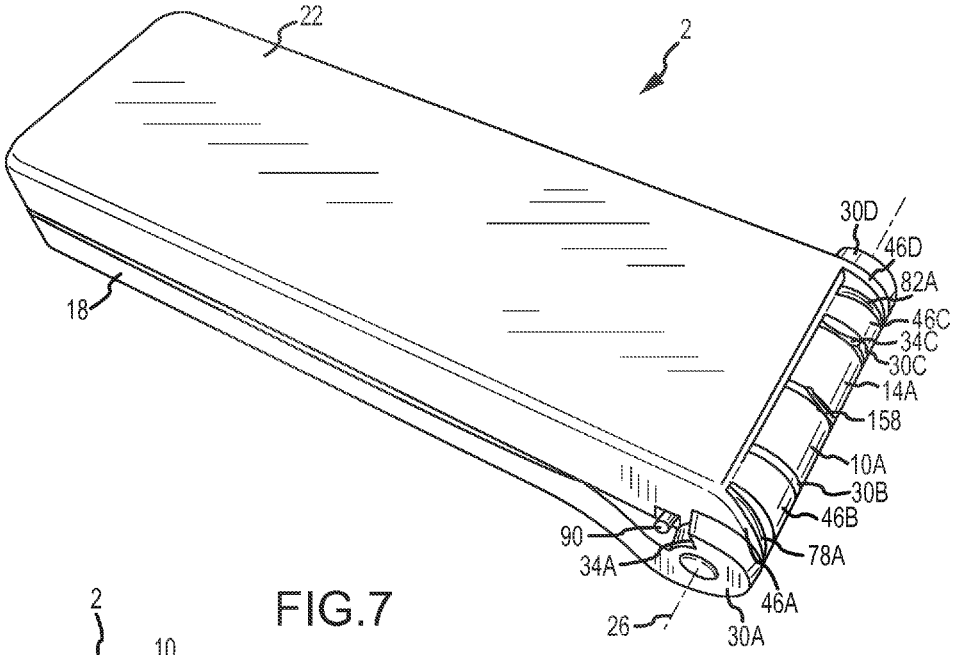
FIG. 7 is a perspective view of the blade-sharpening apparatus shown in FIG. 1 in a folded position.
Figure 8:
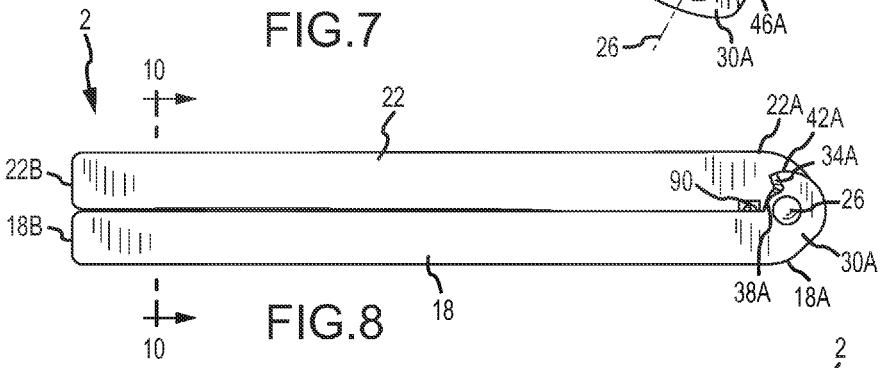
FIG. 8 is front elevation view of the blade-sharpening apparatus shown in FIG. 7.
Figure 9:
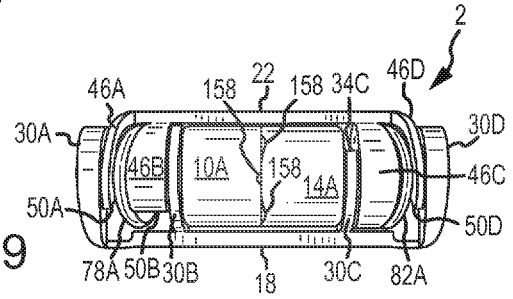
FIG. 9 is a right-side elevation view of the blade-sharpening apparatus shown in FIG. 7.

Referring to FIGS. 7-9, a blade-sharpening apparatus 2 is shown in a folded, or closed, position. In particular, the first cover plate 18 and/or the second cover plate 22 have been rotated into a folded position in which the first cover plate 18 and the second cover plate substantially enclose the first sharpening tool 10, the second sharpening tool 14, the first hand guard 78, and the second hand guard 82. In the folded position, the blade-sharpening apparatus 2 can be easily transported for in-the-field sharpening tasks.

Referring to FIG. 10, a cross-section view taken along line 10-10 of the blade-sharpening apparatus 2 shown in FIG. 7 is provided. In FIG. 10, the blade-sharpening apparatus 2 is in a folded position. The first sharpening tool 10, the second sharpening tool 14, the first hand guard 78, and the second hand guard 82 are held in their respective storage positions by receptacles 62 formed in the first cover plate 18 and the second cover plate 22. A cap plate 142 is interconnected to the first cover plate 18 with fasteners 138, and a finger grip 150 is slidably interconnected to the cap plate 142. The second cover plate 22 includes protruding latch members 66 which are positioned in corresponding latch receptacles 70 formed in the first cover plate 18 to secure the blade-sharpening apparatus 2 in the folded position.

Figure 11:
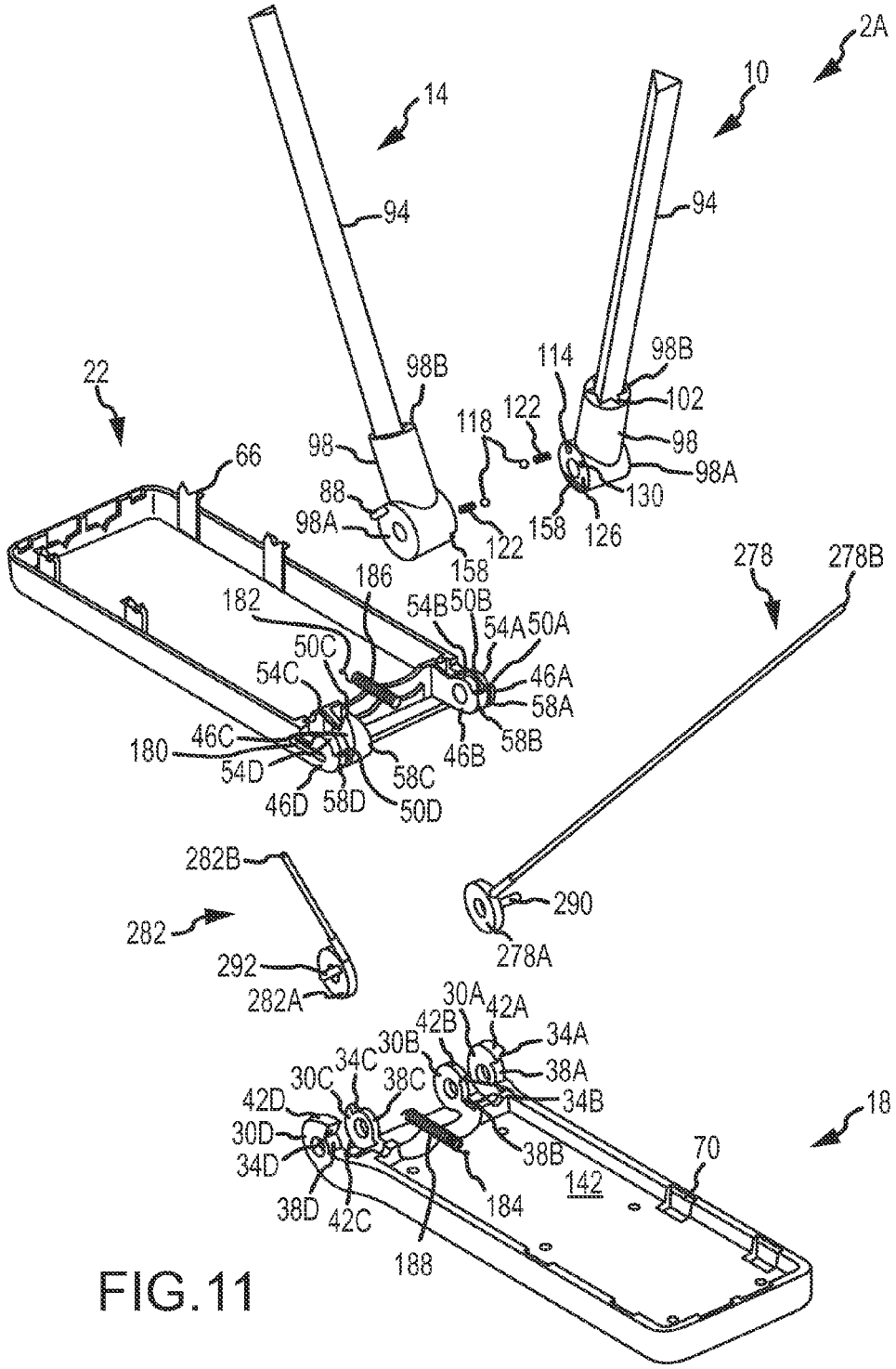
FIG. 11 is an exploded perspective view of a second embodiment of the blade-sharpening apparatus in an unfolded position.

FIG. 11 shows a second embodiment of a blade-sharpening apparatus 2A in an exploded, unfolded position. The blade-sharpening apparatus 2A includes a foldable case 6 having a first cover plate 18 rotatably interconnected to a second cover plate 22 about an axis of rotation. In addition, a first sharpening tool 10 and a second sharpening tool 14 are rotatably interconnected to the first cover plate 18 and the second cover plate 22 about the axis of rotation. The blade-sharpening apparatus 2A of FIGS. 11-13 is similar to the blade-sharpening apparatus 2 according to the first embodiment (FIGS. 1-10). The blade-sharpening apparatus 2A of FIGS. 11-13 does not include a locking mechanism with a cap plate, a slidable rod, a finger grip interconnected to a second end of the slidable rod, and a spring operably associated with the finger grip. Rather, the locking mechanism of the blade-sharpening apparatus 2A includes slots 180 in the end of the second cover plate 22 proximate to the axis of rotation. Each side of the second cover plate includes a slot 180. The blade-sharpening apparatus 2A further includes a bar (not shown in FIG. 11, item 226 in FIGS. 14A-C) positioned along the axis of rotation. A first end of the bar is positioned in the first slot 180 while a second end of the bar is positioned in the second slot (not shown). The bar can slide along the slots 180, thus creating a locking mechanism to lock the blade-sharpening apparatus 2A in an open and flat position. The blade-sharpening apparatus 2A may further include a biasing member (shown cut into two halves 186, 188) interconnected to the second cover plate 22 at a first interconnection point 182 and interconnected to the first cover plate 18 at a second interconnection point 184. The biasing member is configured to bias the first cover plate 18 to the second cover plate 22 such that the rod slides into the desired portion of the slot 180 to lock the blade-sharpening apparatus 2A in an open and flat position.

The blade-sharpening apparatus 2A may also include at least one hand guard. In FIG. 11, the blade-sharpening apparatus 2A includes a first hand guard 278 and a second hand guard 282. The first hand guard 278 and the second hand guard 282 each have a first end 278A, 282A rotatably interconnected to the first end 18A of the first cover plate 18 and to the first end 22A of the second cover plate 22 about the axis of rotation, which may be accomplished by use of a pivot pin or rod. The first hand guard 278 and the second hand guard 282 each have a second end 278B, 282B opposite the first end 278A, 282A. The first hand guard 278 and the second hand guard 282 each have a holder proximate to the first ends 282A, 278A into which a rod-like member is inserted. The holders may be similar to the holder 98 for the sharpening rods 94. The first hand guard 278 and the second hand guard 282 are rotatable between a storage position, shown in FIGS. 10, 14A, 14B, and 14C, and a guard position, shown in FIGS. 12A-B and 13. When rotated to the guard position, the first hand guard 278 and the second hand guard 282 are positioned at approximately the same predefined angle relative the first cover plate 18 and the first rotatable tool 10. Similar to the predetermined angle of the sharpening tools, the predefined angle of the hand guards may be preset to a particular angle or adjustable. Generally, the hand guards 278, 282 protect a user's hand while sharpening. In one embodiment, a blade sharpening apparatus 2 includes hand guards 278, 282 that can be preset between about 30 to about 150 degrees relative to each other, or between about 15 to about 75 degrees relative to a vertical plane passing through the axis of rotation. In one embodiment, hand guards 278, 282 are preset at about 106 degrees relative to each other, or about 53 degrees relative to a vertical plane passing through the axis of rotation.

The rotation of the first sharpening tool 10, the second sharpening tool 14, the first hand guard 278, and/or the second hand guard 282 about the axis of rotation may be coupled to the rotation of the first cover plate 18 and the second cover plate 22. For example, rotation of the first cover plate 18 or the second cover plate 22 from a folded position to an unfolded position may rotate the first sharpening tool 10 and the second sharpening tool 14 from their respective storage positions to their respective sharpening positions. Similarly, rotation of the first cover plate 18 or the second cover plate 22 from a folded position to an unfolded position may rotate the first hand guard 278 and the second hand guard 282 from their respective storage positions to their respective guard positions. Further, rotation of the first cover plate 18 or second cover plate 22 from an unfolded to a folded position may rotate the first sharpening tool 10, second sharpening tool 14, first hand guard 278, and/or second hand guard 282 to their respective storage positions. The first end 278A of the first hand guard 278 and the first end 282A of the second hand guard 282 may each include a tab 290, 292, respectively, that generally extends along the axis of rotation. The tab 290 formed on the first end 278A of the first hand guard 278 is configured to interact with the contact surface 34A formed in the first knuckle 30A of the first cover plate 18 and/or the contact surface 50A formed in the first knuckle 46A of the second cover plate 22. The tab 292 formed on the first end 282A of the second hand guard 282 is configured to interact with the contact surface 34D formed in the fourth knuckle 30D of the first cover plate 18 and/or the contact surface 50D formed in the fourth knuckle 46D of the second cover plate 22. In another embodiment, each holder of the first and second hand guards 278, 282 may house a ball detent in a cavity formed in a first end of each holder, similar to the balls 118 and cavities 114 of the holders 98 of the sharpening tools 10, 14. If provided, the ball is interconnected to a spring, and the spring and ball are placed in the cavity such that a portion of the ball protrudes out of the cavity. When assembled, the ball contacts a side surface of an adjacent holder, compresses the spring, and is retracted into the cavity. The ball remains retracted in the cavity until the first sharpening tool 10, the second sharpening tool 14, the first hand guard 278, and the second hand guard 282 are rotated into their sharpening or open positions, at which point a recess formed in the side surface of the adjacent holder aligns with the cavity, allowing the spring to expand and position a portion of the ball in the recess. If a ball, spring, and cavity are used, then one or more tabs 88, 90, 290, 292 may not be needed. Alternatively, other types of retention mechanisms known in the art may be used.

Figure 12A:
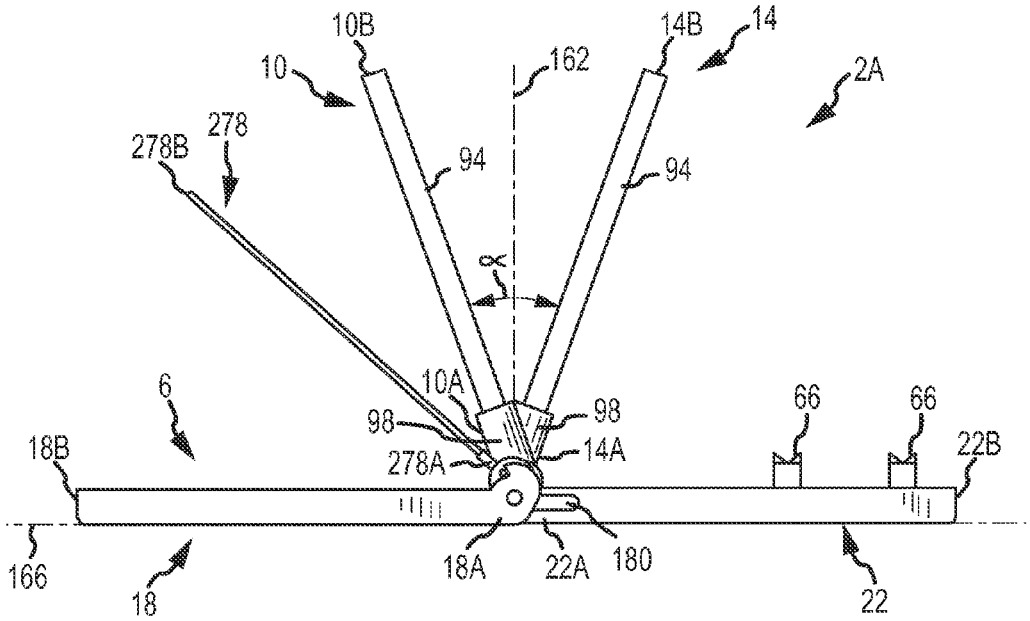
FIG. 12A is a front elevation view of the blade-sharpening apparatus shown in FIG. 11 in a first open position.
Figure 12B:
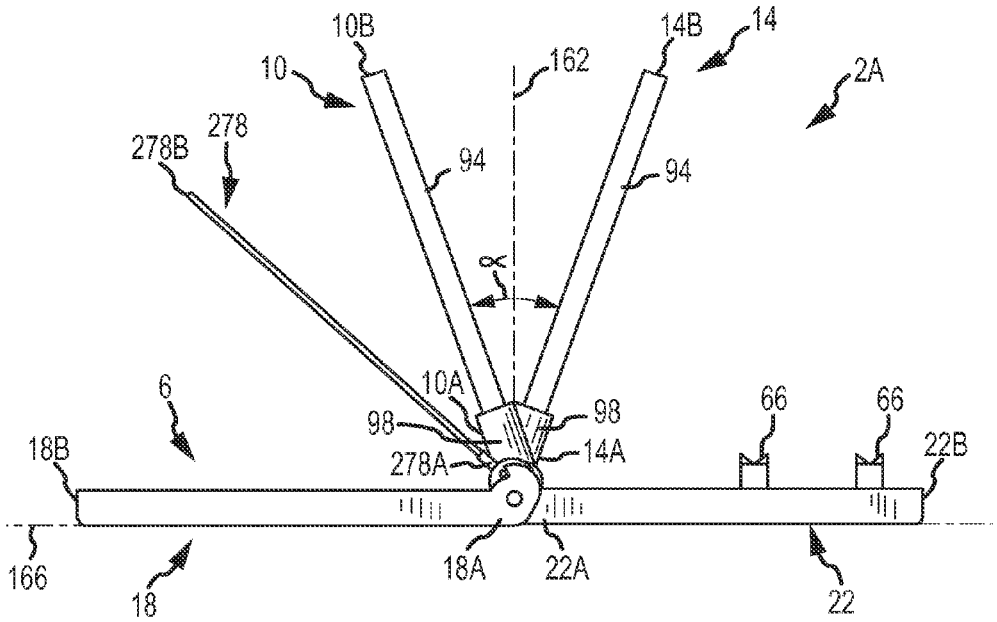
FIG. 12B is a front elevation view of the blade-sharpening apparatus shown in FIG. 11 in a second open and locked position.
Figure 13:
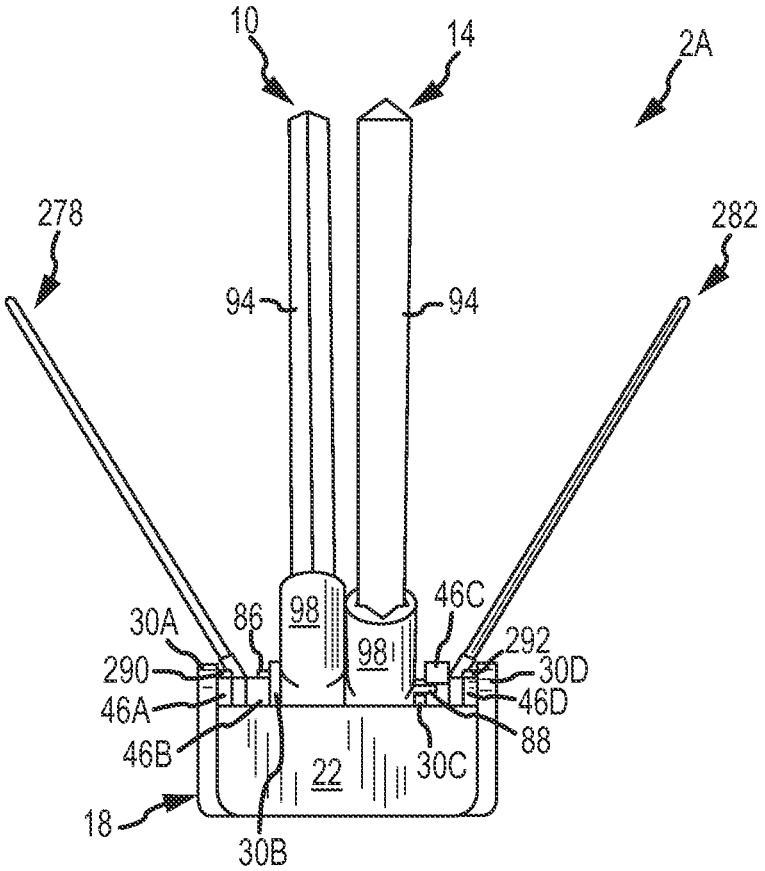
FIG. 13 is a right-side elevation view of the blade-sharpening apparatus shown in FIG. 11.

FIGS. 12A-B show the first cover plate 18 and the second cover plate 22 rotated to an unfolded position in which the first cover plate 18 and the second cover plate 22 extend away from each other and act as a base of the blade-sharpening apparatus 2A. Specifically, FIG. 12A shows the blade-sharpening apparatus 2A when the rod is positioned in a portion of the slot 180 proximate to the first end 22A of the second cover plate 22. FIG. 12B shows the blade-sharpening apparatus 2A when the rod is positioned in a portion of the slot 180 proximate to the second end 22B of the second cover plate 22. Thus, the slot 180 is not visible in FIG. 12B because the slot 180 is hidden behind the first cover plate 18. In FIGS. 12A-B, the first cover plate 18 and the second cover plate 22 are positioned substantially co-planar with a horizontal plane 166. As such, in this embodiment, the first cover plate 18 and the second cover plate 22 are rotatable between about 180 degrees. The rod is slid along the slot 180 to lock the blade-sharpening apparatus 2A in an open position.

Referring now to FIG. 13, a right-side elevation view of a blade-sharpening apparatus 2A is provided. The first hand guard 278 and the second hand guard 282 have been rotated to a guard position in which the hand guards 278, 282 are angled outwardly from the first sharpening tool 10 and the second sharpening tool 14. The outward orientation helps protect a user's hand, wrist, and/or arm when placed on the first cover plate 18. When in the storage position (FIGS. 10 and 14A-C), the hand guards 278, 282 are positioned within an interior space defined by the first cover plate 18 and the second cover plate 22. When in the guard position, the hand guards 278, 282 extend beyond the outermost exterior surfaces of the first cover plate 18 and the second cover plate 22 to provide additional protection for a user's hand during sharpening. The outward orientation of the hand guards 278, 282 relative to the cover plates 18, 22 and/or the sharpening tools 10, 14 may be altered in various embodiments.

Figure 14A:
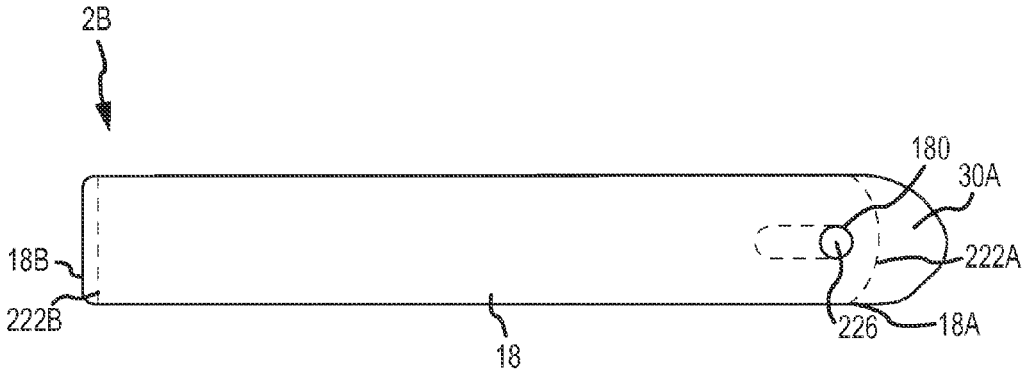
FIG. 14A is front elevation view of a third embodiment of the blade-sharpening apparatus in a first folded position.

Referring to FIG. 14A, a third embodiment of a blade-sharpening apparatus 2B is shown in a first folded, or closed, position. In particular, the first cover plate 18 and/or the second cover plate (positioned within the first cover plate 18 and shown in phantom) have been rotated into a folded position in which the first cover plate 18 and the second cover plate substantially enclose the first sharpening tool 10, the second sharpening tool 14, the first hand guard 278, and the second hand guard 282. In the first folded position, the blade-sharpening apparatus 2B can be easily transported for in-the-field sharpening tasks. In the first folded position, the second end 222B of the second cover plate is positioned proximate to the second end 18B of the first cover plate 18 and the rod 226 is positioned in a portion of the slot 180 closest to the first end 222A of the second cover plate.

Figure 14B:
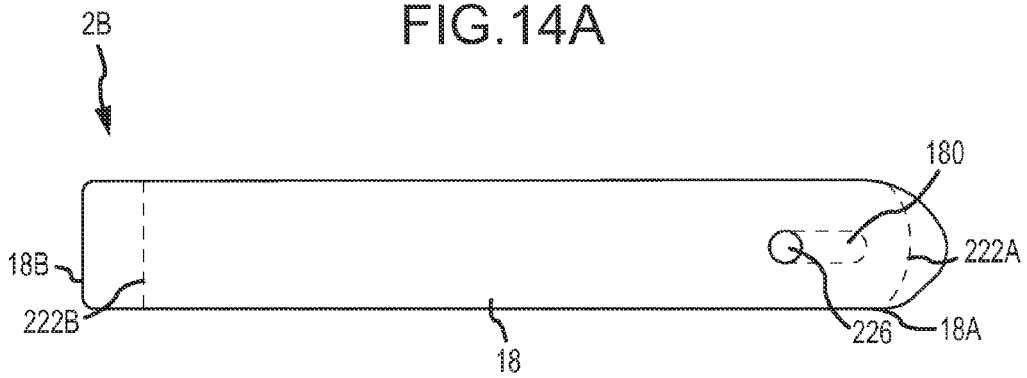
FIG. 14B is front elevation view of the blade-sharpening apparatus of FIG. 14A in a second folded position.
Figure 14C:
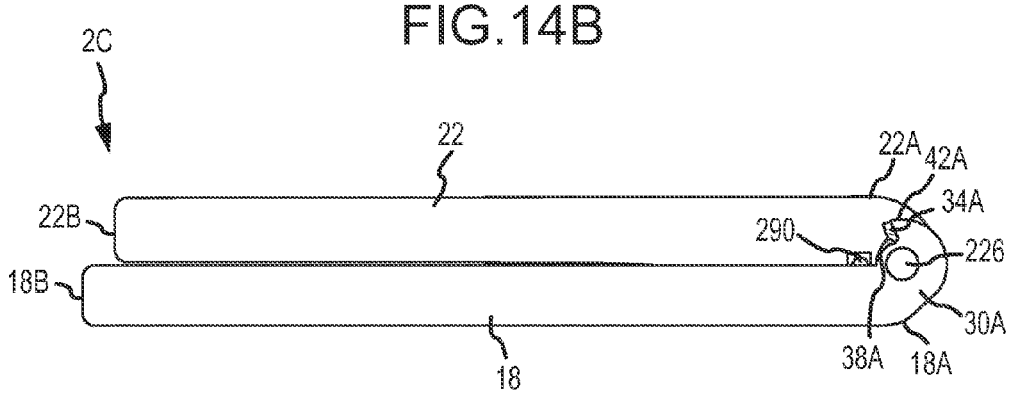
FIG. 14C is front elevation view of a fourth embodiment of the blade-sharpening apparatus in a folded position.

Referring to FIG. 14B, the blade-sharpening apparatus 2B of FIG. 14A is shown in a second folded, or closed, position. In particular, the first cover plate 18 and/or the second cover plate (positioned within the first cover plate 18 and shown in phantom) have been rotated into a folded position in which the first cover plate 18 and the second cover plate substantially enclose the first sharpening tool 10, the second sharpening tool 14, the first hand guard 278, and the second hand guard 282. In the second folded position, the blade-sharpening apparatus 2B can be easily transported for in-the-field sharpening tasks. In the second folded position, the second end 222B of the second cover are within the scope and spirit of the claimed invention, as set forth in the following claims.

The invention claimed is:

1. A blade-sharpening apparatus, comprising:

a foldable case positionable between a folded position and an unfolded position, wherein the foldable case comprises a first cover plate rotatably interconnected to a second cover plate via a pin extending through two apertures in a first end of the first cover plate and two apertures in a first end of the second cover plate;

a first sharpening tool having a first end and a second end, the first end of the first sharpening tool interconnected to the foldable case, the first sharpening tool rotatable between a storage position and a sharpening position, wherein rotation of the first sharpening tool is coupled to rotation of the foldable case; and a first holder having a first end rotatably interconnected to the foldable case and a second end, wherein the pin extends through the first end of the first holder such that the first holder can rotate around the pin, wherein the first sharpening tool comprises a sharpening rod removably interconnected to the first holder, and wherein the second end of the first holder includes a predetermined geometry adapted to receive and selectively orient the sharpening rod.

2. The blade-sharpening apparatus of claim 1, further comprising a second sharpening tool having a first end and a second end, the first end of the second sharpening tool interconnected to the foldable case, the second sharpening tool rotatable between a storage position and a sharpening position, and wherein rotation of the second sharpening tool is coupled to rotation of the foldable case.

3. The blade sharpening apparatus of claim 2, further comprising a second holder having a first end rotatably interconnected to the foldable case and a second end, wherein the pin extends through an aperture in the first end of the second holder such that the second holder can rotate around the pin, wherein the second sharpening tool comprises a sharpening rod removably interconnected to the second holder, and wherein the second holder and the pin to interconnect the second sharpening tool to the foldable case.

4. The blade-sharpening apparatus of claim 2, wherein when the foldable case is in the folded position, the first and second cover plates substantially enclose the first and second sharpening tools.

5. The blade-sharpening apparatus of claim 1, wherein the sharpening rod has a triangular cross-section.

6. The blade-sharpening apparatus of claim 1, wherein the first sharpening tool is adapted to be selectively locked in the sharpening position to retain a substantially fixed position.

7. The blade-sharpening apparatus of claim 1, further comprising at least one hand guard with a first end which rotates about a common axis shared with the first sharpening tool, and having a second end which rotates to a position outside of at least one of a perimeter edge of the first cover plate and a perimeter edge the second cover plate.

8. A blade-sharpening apparatus, comprising:

a first cover plate having a first end with two apertures and a second end;

a pin extending through the two apertures in the first end of the first cover plate;

a second cover plate having a first end with two apertures and a second end, the first end of the second cover plate interconnected to the first end of the first cover plate via the pin extending through the two apertures in a first end of the second cover plate, wherein at least one of the first and second cover plates is rotatable between a folded position and an unfolded position;

a first holder having a first end and a second end, the first end of the first holder interconnected to the pin, wherein the first holder is rotatable between a storage position and a sharpening position;

a first sharpening rod removably interconnected to the second end of the first holder; and a first hand guard having a first end interconnected to the pin, wherein the first hand guard is rotatable between a storage position and a guarding position.

9. The blade-sharpening apparatus of claim 8, wherein when the first and second cover plates are in the unfolded positions, the first and second cover plates extend away from each other and act as a base of the blade-sharpening apparatus.

10. The blade-sharpening apparatus of claim 8, wherein when the first and second cover plates are in the folded positions, the first and second cover plates substantially enclose the first holder, the first sharpening rod, and the first hand guard.

11. The blade-sharpening apparatus of claim 8, further comprising a second holder having a first end and a second end, the first end of the second holder interconnected to the pin, wherein the second holder is rotatable between a storage position and a sharpening position; and a second sharpening rod removably interconnected to the second end of the second holder.

12. The blade-sharpening apparatus of claim 11, wherein rotation of the first and second holders is coupled to at least one of the first and second cover plates, and wherein rotation of the at least one of the first and second cover plates from the folded position to the unfolded position rotates the first and second holders from their respective storage positions to their respective sharpening positions.

13. The blade-sharpening apparatus of claim 12, wherein the first end of each holder includes a tab configured to interact with the first end of at least one of the first and second cover plates to couple the first and second holders to the at least one of the first and second cover plates.

14. The blade-sharpening apparatus of claim 11, wherein the first and second holders are adapted to be selectively locked in their respective sharpening positions to retain a substantially fixed position.

15. The blade-sharpening apparatus of claim 8, wherein rotation of the first hand guard is coupled to at least one of the first and second cover plates, wherein rotation of the at least one of the first and second cover plates from the folded position to the unfolded position rotates the first hand guard from the storage position to the guarding position.

16. The blade-sharpening apparatus of claim 11, wherein the first and second sharpening tools are oriented at a predetermined angle relative to each other when the first and second sharpening tools are in their respective sharpening positions.

17. A blade-sharpening apparatus, comprising:

a foldable case positionable between a folded position and an unfolded position;

a first holder having a first end rotatably interconnected to the foldable case and a second end;

a first sharpening rod having a first end and a second end, the first end of the first sharpening rod removably interconnected to the second end of the first holder such that the first sharpening rod is rotatable between a storage position and a sharpening position, wherein rotation of the first sharpening rod is coupled to the foldable case, and wherein the second end of the first holder includes a predetermined geometry adapted to receive and selectively orient the first sharpening rod;

a second holder having a first end rotatably interconnected to the foldable case and a second end; and a second sharpening rod having a first end and a second end, the first end of the second sharpening rod removably interconnected to the second end of the second holder such that the second sharpening rod is rotatable between a storage position and a sharpening position, wherein rotation of the second sharpening rod is coupled to the foldable case, and wherein the second end of the second holder includes a predetermined geometry adapted to receive and selectively orient the second sharpening rod.

* * * * *